US008898000B2

(12) United States Patent
Mcaree et al.

(10) Patent No.: US 8,898,000 B2
(45) Date of Patent: Nov. 25, 2014

(54) COLLISION AVOIDANCE SYSTEM AND METHOD FOR HUMAN COMMANDED SYSTEMS

(75) Inventors: Peter Ross Mcaree, St. Lucia (AU); Michael Peter Kearney, Milton (AU)

(73) Assignee: Ezymine Pty Limited, Pinjarra Hills, Queensland (AU)

( * ) Notice: Subject to any disclaimer, the term of this patent is extended or adjusted under 35 U.S.C. 154(b) by 5 days.

(21) Appl. No.: 13/883,617

(22) PCT Filed: Nov. 8, 2011

(86) PCT No.: PCT/AU2011/001428

§ 371 (c)(1),
(2), (4) Date: May 6, 2013

(87) PCT Pub. No.: WO2012/061874

PCT Pub. Date: May 18, 2012

(65) Prior Publication Data

US 2013/0231855 A1 Sep. 5, 2013

(30) Foreign Application Priority Data

Nov. 8, 2010 (AU) ..... 2010904962

(51) Int. Cl.

| | |
|---|---|
| ***G08G 99/00*** | (2006.01) |
| ***E02F 9/20*** | (2006.01) |
| ***E02F 9/24*** | (2006.01) |
| ***E02F 9/26*** | (2006.01) |

(52) U.S. Cl.

CPC ..... *G08G 99/00* (2013.01); *E02F 9/2033* (2013.01); *E02F 9/24* (2013.01); *E02F 9/262* (2013.01)

USPC ..... 701/301; 701/25

(58) Field of Classification Search

USPC ..... 701/301, 25

See application file for complete search history.

(56) References Cited

U.S. PATENT DOCUMENTS

| | | | | |
|---|---|---|---|---|
| 6,317,691 | B1 | 11/2001 | Narayan et al. | |
| 2004/0212676 | A1 | 10/2004 | Mathes et al. | |
| 2006/0184294 | A1 * | 8/2006 | Ma et al. ..... | 701/25 |
| 2010/0094520 | A1 | 4/2010 | Zagorski | |

OTHER PUBLICATIONS

PCT Search Report and Written Opinion for PCT/AU2011/001428, completed Mar. 7, 2012.

* cited by examiner

*Primary Examiner* — Mary Cheung
*Assistant Examiner* — Yuen Wong
(74) *Attorney, Agent, or Firm* — Barnes & Thornburg LLP

(57) ABSTRACT

A method of implementing an optimal avoidance filter for interposing between a human operator issued movement commands and a corresponding machine control system of a movable machine, for the avoidance of collisions with objects. The method: includes inputting a detailed representation of objects in the vicinity of the movable machine; and formulating a hierarchical set of bounding boxes around the objects. The hierarchical set including refinement details depending on the current positional state of the movable machine, with objects closer to the machine having higher levels of refinement details. The method further includes utilizing the resultant hierarchical set as a set of constraints for a mixed integer optimization problem to determine any alterations to the issued movement commands so as to avoid collisions with any objects.

8 Claims, 10 Drawing Sheets

(a) One ABB - coarsest representation (b) 16 ABBs - coarse representation (c) 256 ABBs - fine representation (d) Polygonal model - finest representation

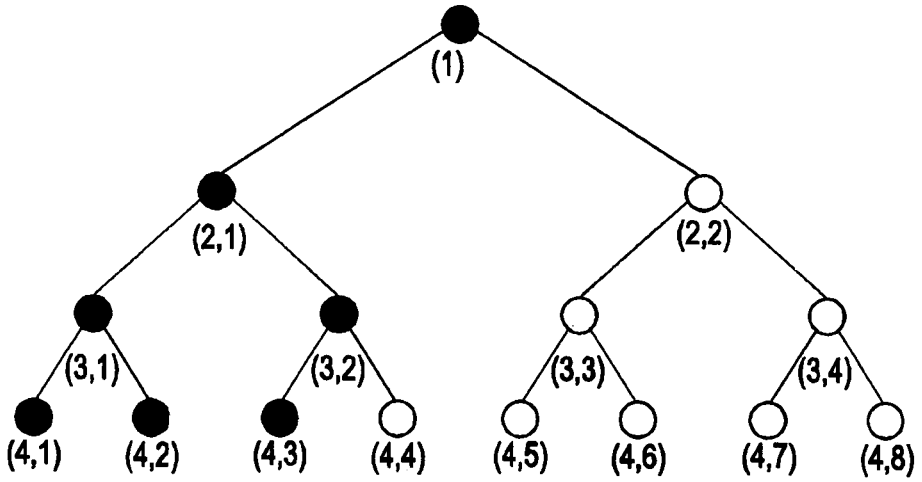

(a) BVH showing which boxes intersect with $\mathcal{R}$ (coloured in circles)

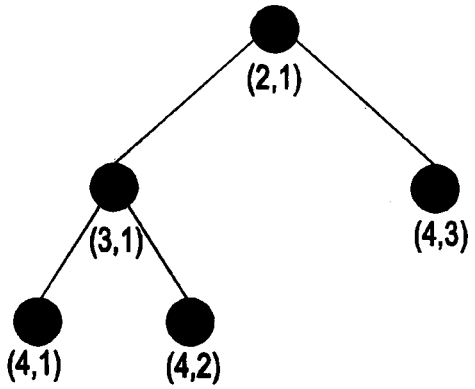

(b)Reduced BVH

Fig. 12

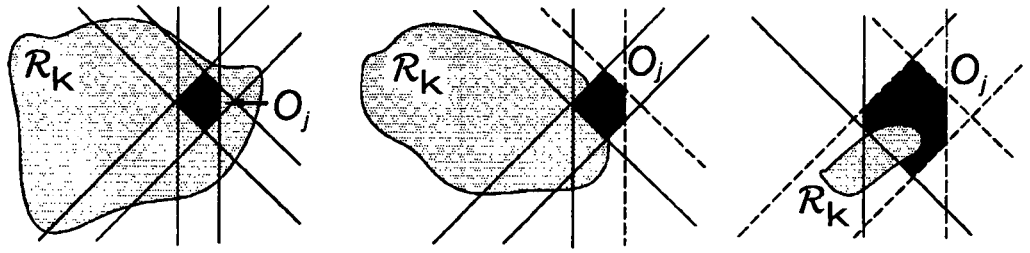

(a) Obstacle completely inside reachable set, all constraints are reachable. Binary variables are required (b) Obstacle overlaps reachable set with 2 or more constraints reachable. Binary variables are required (c) Obstacle overlaps reachable set with only 1 constraint reachable. No binary variables are required

Fig. 13

(a) Side view (b) Back view

COLLISION AVOIDANCE SYSTEM AND METHOD FOR HUMAN COMMANDED SYSTEMS

CROSS-REFERENCE TO RELATED APPLICATIONS

This application is the U. S. national phase of PCT/AU2011/001428 filed Nov. 8, 2011. PCT/AU2011/001428 claims priority to Australian patent application 2010904962 filed Nov. 8, 2010. The disclosures of both AU 2010904962 and PCT/AU2011/001428 are hereby incorporated herein by reference.

FIELD OF THE INVENTION

The present invention relates to collision avoidance systems and methods and, in particular, discloses a system and method for a collision avoidance frame work for human commanded systems such as mining shovels or the like.

REFERENCES

Barraquand, J., Langlois, B. & Latombe, J. (1992), 'Numerical potential-field techniques for robot path planning', IEEE Transactions On Systems Man And Cybernetics 22(2), 224-241.

Bellingham, J., Richards, A. & How, J. (2002), Receding horizon control of autonomous vehicles, in 'Proc. of the American Control Conf'.

Bemporad, A. & Moran, M. (1999), 'Control of systems integrating logic, dynamics, and constraints', Automatica 35(3), 407-427.

Blanchini, F. (1999), 'Set invariance in control [survey paper]', Automatica 35, 1747-1767.

Blanchini, F. & Miani, S. (2008), Set-Theoretic Methods in Control, Systems & Control: Foundations & Applications, Birkhauser, Boston, Basel, Berlin.

Blanchini, F., Pellegrino, F. A. & Visentini, L. (2004), 'Control of manipulators in a constrained workspace by the means of linked invariant sets', International Journal of Robust and Nonlinear Control 14, 1185-1205.

Cohen, J., Lin, M. C., Manocha, D. & Ponamgi, K. (1995), I-collide: Am interactive and exact collision detection system for large-scaled environments, in 'Proceedings of ACM Int. 3D Graphics Conference', ACM Press, pp. 189-196.

Culligan, K. (2006), Online trajectory planning for uavs using mixed integer programming, Master's thesis, MIT, Aerospace Control Lab.

Daniel, R. & McAree, P. (1998), 'Fundamental limits of performance for force reflecting teleoperation', International Journal Of Robotics Research 17(8), 811-830.

Daniel, R. & McAree, P. (2000), 'Multivariable stability of force-reflecting teleoperation: Structures of finite and infinite zeros', International Journal Of Robotics Research 19(3), 203-224.

Floudas, C. (1995), Non-linear and Mixed Integer Optimization: Fundamentals and Applications, Topics in Chemical Engineering, Oxford University Press, New York.

Gottschalk, A. S., Lin, M. C. & Mancha, D. (1996), Obbtree: a hierarchical structure for rapid interference detection, in 'Proceedings of the 23rd annual conference on Computer graphics and interactive techniques', ACM Press, pp. 171-180.

ILOG (2007), ILOG CPLEX SYSTEM Version 10.2 Users Guide. 49

Kearney, M., Raković, S. & McAree, P. (2009), Optimal cost control correction: A set-theoretic approach, in 'Proc. European Control Conference [accepted]'.

Khatib, O. (1986), 'Real-time obstacle avoidance for manipulators and mobile robots', International Journal of Robotics Research 5(1), 90-98.

Kuwata, Y. (2003), Real-time Trajectory Design for Unmanned Aerial Vehicles using Receding Horizon Control, Masters, MIT.

Kuwata, Y. (2007), Trajectory planning for unmanned vehicles using robust receding horizon control, Phd, MIT.

Kuwata, Y. & How, J. P. (2004), Three dimensional receding horizon control for uays, in 'AIAA Guidance, Navigation, and Control Conference', Providence, R.I., USA.

Kuwata, Y., Richards, A., Schouwenaars, T. & How, J. (2007), 'Distributed robust receding horizon control for multi-vehicle guidance', IEEE Transactions on Control Systems Technology 15(4), 627-641.

Latombe, J.-C. (1991), Robot motion planning, Kluwer Academic, Boston, Mass.

LaValle, S. M. (2006), Planning Algorithms, Cambridge University Press, Cambridge, U.K. available at http://planning cs uiuc.edu/.

Maciejowski, J. (2002), Predictive control: with constraints, Pearson Education Limited, Harlow, England.

Mayne, D. Q., Rawlings, J. B., Rao, C. V. & Scokaert, P. O. M. (2000), 'Constrained model predictive control: Stability and optimality', Automatica 36(6), 789-814.

McAree, P. & Daniel, R. (2000), 'Stabilizing impacts in force-reflecting teleoperation using distance-to-impact estimates', International Journal Of Robotics Research 19(4), 349-364.

Mignone, D. (2001), The REALLY BIG Collection of Logic Propositions and Linear Inequalities, Technical report, Automatic Control Lab, ETH Zurich.

Rakovi¶c, S. & Mayne, D. Q. (2005), Robust time optimal obstacle avoidance problem for constrained discrete time systems, in '44th IEEE conference on Decision and Control', IEEE, Seville, Spain, pp. 981-986.

Raković, S. V., Blanchini, F., E. Cruck & Morari, M. (2007), Robust Obstacle Avoidance for Constrained Linear Discrete Time Systems: A Set-theoretic Approach, in 'IEEE Conference on Decision and Control'.

Raković, S. V. & Mayne, D. Q. (2007), 'Robust Model Predictive Control for Obstacle Avoidance: Discrete Time Case', Lecture Notes in Control and Information Sciences (LNCIS) 358, 617-627.

Ren, J., McIsaac, K. & Patel, R. (2006), 'Modified Newton's method applied to potential field-based navigation for mobile robots', IEEE Transactions On Robotics 22(2), 384-391.

Richards, A. G. (2002), Trajectory Optimization using Mixed-Integer Linear Programming, Masters, MIT.

Richards, A. G. (2005), Robust Constrained Model Predictive Control, Phd, MIT.

Richards, A., Kuwata, Y. & How, J. (2003), Experimental demonstration of real-time milp control, in 'AIAA Guidance, Navigation and Control Conference', Austin, Tex.

Rossiter, J. (2003), Model-based predictive control: a practical approach, CRC Press, Boca Raton, Fla.

Schouwenaars, T. (2006), Safe Trajectory Planning of Autonomous Vehicles, Phd, MIT.

Sheridan, T. (1993), 'Space teleoperation through time-delay—review and prognosis', IEEE Transactions On Robotics And Automation 9(5), 592-606.

Slutski, L. (1998), Remote manipulation systems: quality evaluation and improvement, International series on microprocessor-based and intelligent systems engineering, Kluwer Academic, Dordrecht, the Netherlands.

Smith, Z. V. (2008), Algorithms for Collision Hulls and their Applications to Path Planning in Open-Cut Mining, PhD thesis, University of Queensland, Mechanical Engineering [submitted].

Thompson, R., McAree, P., Daniel, R. & Murray, D. (2005), 'Operator matching during visually aided teleoperation', Robotics And Autonomous Systems 50(1), 69-80.

BACKGROUND

In any part human operated machinery environment, in industrial and other environments, it is important for the machinery to avoid collisions with other objects. One important example of such an environment is in an open cut mining excavation environment.

FIG. 1 depicts a mining shovel loading a haul truck. This is a common activity in open-cut mining, but one which carries the significant risk of collision between the shovel and the truck. It would be desirable to have a technology that assists operators of earth-moving equipment to avoid such collisions. However, the need for such a technology arises in more or less the same form in several teleoperation contexts including nuclear decommissioning (Thompson et al. 2005, McAree & Daniel 2000, Daniel & McAree 2000, 1998) and space applications (Sheridan 1993). The aim is to filter the operator command so that the operator's intent is realized while avoiding collisions between the slave and obstacles in its workspace. The problem is characterized by (i) the presence of a human-in-the-loop who provides a command reference to the slave manipulator to achieve some defined task; (ii) significant energy associated with motion of the slave, with a high likelihood for damage-causing impacts between it and obstacles within its workspace; (iii) rate and saturation constraints on inputs states and outputs which limit the rate at which energy can be removed from and injected into the slave; (iv) the slave and workspace obstacles having non-convex geometries; and (v) a requirement for the slave to manoeuvre within concavities of obstacles.

Previous relevant work includes potential-field avoidance methods (Khatib 1986), motion planning (Latombe 1991, LaValle 2006), receding horizon trajectory planning (denoted RHTP) (Bellingham et al. 2002, Richards et al. 2003, Kuwata 2007, Kuwata et al. 2007) and set-theoretic control methods (Raković & Mayne 2005, Blanchini et al. 2004, Raković & Mayne 2007, Raković et al. 2007). Potential field obstacle avoidance methods were first explored in Khatib (1986) and have been applied frequently to obstacle avoidance problems, see for example (Latombe 1991, LaValle 2006, Ren et al. 2006, Barraquand et al. 1992). These methods use potential fields around each obstacle to determine planning or control laws that repel the manipulator. The approach, while conceptually attractive, suffers from the drawback that the potential field does not explicitly take account of the dynamics and performance limitations of the manipulator. Careful crafting of the potential field is required to guarantee avoidance and ensure that no alteration occurs in situations where collisions will not occur, such as moving parallel to an obstacle face. Motion planning methods, by way of contrast, seek to find a path from an initial configuration of a robot to a desired configuration avoiding all obstacles en route. These methods are most commonly used in autonomous robotics (Latombe 1991, LaValle 2006). The main differences between the motion planning and avoidance filtering problems is the objective and the available information: the final goal of the robot is known in the motion planning problem, hence the problem is fully specified, while for the avoidance filtering problem future commands are not known, and the objective is to minimize the alteration from the operator's command.

RHTP, for example, calculates the path to the goal configuration using a receding horizon control framework with the property that each time step, the minimum-cost trajectory to the goal configuration is computed and the first action is taken. This control structure allows for changes to the environment and the goal configuration to occur during the operation. RHTP can be implemented for polytopal obstacles, polytopal system constraints and linear (or piecewise afine) dynamics using MIP, see for example (Bellingham et al. 2002, Richards et al. 2003, Kuwata 2007, Kuwata et al. 2007). Set-theoretic control methods (Blanchini & Miani 2008) have also been applied to obstacle avoidance problems. Dynamic programming-based set iterates, for instance, have been used to robustly drive the state to the origin while avoiding obstacles (Rakovic & Mayne 2005), and linked invariant sets have been used to solve the obstacle avoidance with tracking problem (Blanchini et al. 2004). Both of these methods solve variations of the motion planning problem and, as such, are applicable to the avoidance filtering problem (Kearney et al. 2009). Set-theoretic methods were not considered because any change to the environment requires the re-computation of the sets which define the avoidance control laws, restricting these methods to a static environment. This attribute of set theoretic methods are not compatible with the level of detail strategy necessary to represent non-convex obstacle sets.

SUMMARY

It is an object of the present invention to provide an improved collision avoidance framework for human commanded systems.

In accordance with a first aspect of the present invention, there is provided a method of implementing an optimal avoidance filter for interposing between a human operator issued movement commands and a corresponding machine control system of a movable machine, for the avoidance of collisions with objects, the method comprising: (a) inputting a detailed representation of objects in the vicinity of the movable machine; (b) formulating a hierarchical set of bounding boxes around the objects, the hierarchical set including refinement details depending on the current positional state of the movable machine, with objects closer to the machine having higher levels of refinement details; (c) utilising the resultant hierarchical set as a set of constraints for an optimisation problem to determine any alterations to the issued movement commands so as to avoid collisions with any objects.

Preferably the method also includes the steps of: (d) utilising the predicted future motion to update the hierarchical set off bounding boxes. In some embodiments, the step (c) further can comprise the step of: (i) determining a series of alternative alterations to the issued movement commands, and costing the series in term of magnitude of alteration, and utlising a lower cost alternative alteration. The set of bounding boxes are preferably axially aligned.

The steps (a) to (c) are preferably applied in a continuous iterative manner

The hierarchical set of bounding boxes preferably can include representation of non convex objects, in the form of convexities in the hierarchical set.

The step (b) further can preferably comprise, for any particular time step, culling members of the set that are not reachable in the current time step.

In accordance with a further aspect of the present invention, there is provided an optimal avoidance filter for interposing between a human operator issued movement commands and a corresponding machine control system of a movable machine, for the avoidance of collisions with objects, the optimal avoidance filter comprising: First input means for inputting a detailed representation of objects in the vicinity of the movable machine; Hierarchical bounding box determination means for formulating a hierarchical set of bounding boxes around the objects, the hierarchical set including refinement details depending on the current positional state of the movable machine, with objects closer to the machine having higher levels of refinement details; Optimisation means utilising the resultant hierarchical set as a set of constraints for a mixed integer optimisation problem to determine any alterations to the issued movement commands so as to avoid collisions with any objects, and outputting the alterations to the movement commands.

BRIEF DESCRIPTION OF THE DRAWINGS

Benefits and advantages of the present invention will become apparent to those skilled in the art to which this invention relates from the subsequent description of exemplary embodiments and the appended claims, taken in conjunction with the accompanying drawings, in which:

FIG. 12 illustrates the simplification of a BVH using Propositions 5.1 and 5.2.

FIG. 13 illustrates three different intersection situations for reachable constraints. Bold lines indicate reachable constraints, while dashed lines represent unreachable constraints.

DETAILED DESCRIPTION

Figure 1:
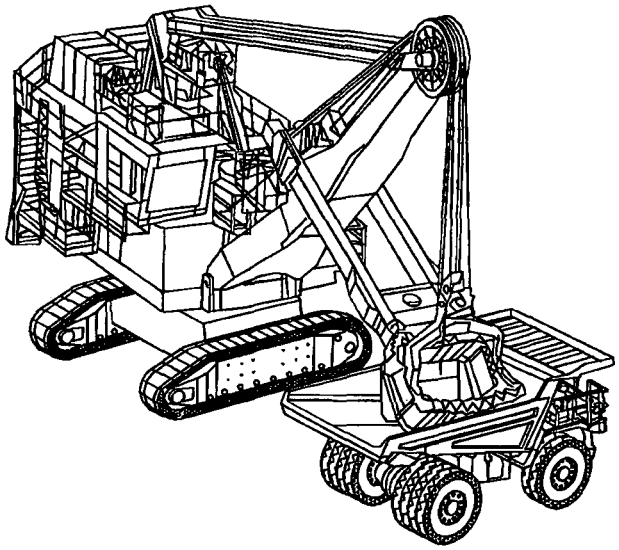
FIG. 1 illustrates an Electric mining shovel loading a haul truck.

Preferred embodiments of the invention will now be described, by way of example only, with reference to the accompanying drawings.

The preferred embodiment utilises an optimal avoidance filter (or OAF) and it is synthesized using a receding horizon control (RHC) framework in which the control action is determined by predicting the future evolution of the system over a given horizon, optimizing the control sequence over the horizon to obtain the most desirable future system evolution, and applying the first control action in the optimized control sequence (Rossiter 2003, Maciejowski 2002). RHC has two attributes that are advantageous when applied to the avoidance filtering problem. First, the predictive nature of receding horizon control allows the constraints associated with the slave manipulator, e.g. actuator torque and speed constraints, to be explicitly taken into account when determining the control action. Second, the future avoidance of obstacles can be guaranteed, even when the operator's future commands are not known, provided the avoidance filter is recursively feasible (Rossiter 2003). A significant challenge is the representation of obstacles. Abstractly, there exists a collision set $C_{obs}$ in the configuration space of the slave that is to be manoeuvred around, defined as the set of configurations where the slave intersects with workspace obstacles (or itself). $C_{obs}$ is well defined mathematically, but difficult to compute. We utilize recent work by Smith (2008) who has presented algorithms for representing $C_{obs}$ in a form that is suitable for incorporation into a receding horizon control framework. In particular, these algorithms approximate $C_{obs}$ as a hierarchy of axially-aligned bounding-boxes. The OAF formulation draws an appropriate representation from this hierarchy and expresses the resulting constraints as a family of mixed integer linear inequalities to be satisfied. The OAF is synthesized as a mixed integer program (MIP) using the approximation of $C_{obs}$, denoted $\hat{C}_{obs}$ drawn by the OAF from the hierarchy of axially-aligned bounding boxes. The requirement to run in real-time places restrictions on the level and apportioning of geometric detail in $\hat{C}_{obs}$. Intuitively, higher detail is desired in regions where the slave manipulator currently is and is likely to go within the prediction horizon, while the remainder of $\hat{C}_{obs}$ can be represented more coarsely.

The preferred embodiment is directed to the complimentary questions of (i) how to draw an efficient representation of $C_{obs}$ from a level of detail representation, at each time step given the current state of the slave manipulator and operator command and (ii) how to embed this level-of-detail within the OAF MIP. Two strategies are examined. The first looks to determine the most appropriate $\hat{C}_{obs}$ as part of the OAF MIP. The second looks to use a prediction of future motion to determine a level-of-detail approximation that is fit-for-purpose and provide this to the OAF MIP. Both strategies produce similar solutions, but the second is shown to have a significantly lower computational cost. Further reduction in computational cost is achieved by removing those obstacle avoidance constraints than cannot be active on the prediction horizon from the OAF MIP. Restrictions are identified on how $\hat{C}_{obs}$ can change between samples to ensure that the OAF remains recursively feasible. A simplified simulation example, based on the shovel-truck avoidance problem, is presented to show the applicability of the methods presented to the motivating problem.

The proposed OAF follows a similar structure to RHTP: a framework based on receding horizon control with avoidance constraints represented using mixed integer inequalities, but will differ in that it will calculate an additive modification to the operator's current command (along the lines of the potential field avoidance method), rather than the command to drive the state to a defined goal configuration.

2 Structure of the OAF

Figure 2:
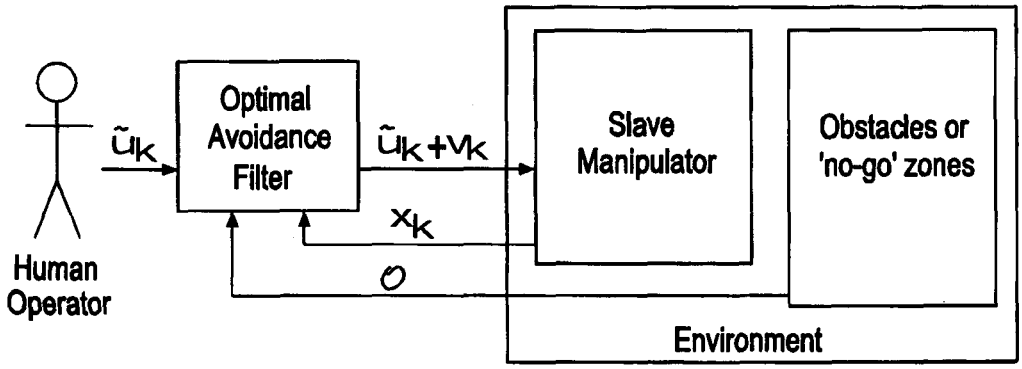
FIG. 2 illustrates a Teleoperated system with the Optimal Avoidance Filter (OAF) interposed between master and slave devices. The OAF calculates an additive modification to the operator command, dependant on the state, and the obstacle set.

FIG. 2 shows schematically a human-operated system made up of

- A slave manipulator which receives an input to perform a desired task. This slave manipulator may include a pre-existing control system. The inputs and states are subject to constraints. The input is often, though not always, a rate command.
- An input device, through which a human operator provides a command input to the slave manipulator. Joysticks are a common form of input device and can be quite sophisticated, e.g. in force reaction applications (Slutski 1998)
- The environment, which contain obstacles whose location and geometry are known. In general, the obstacles have non-convex geometry. It is desired that the slave device does not collide with any of the obstacles in the environment.

The OAF is interposed between the input device and the slave manipulator (as shown in FIG. 2) and computes and additive alteration to the operator reference so that the slave avoids collision with obstacles. The OAF also ensures that the constraints of the slave manipulator are satisfied. The OAF objective function is chosen to ensure that the alteration from the operator command is minimal, although alternative objectives could be chosen within this framework.

2.1 Notation and Definitions

- Variables are represented using the following convention: spaces (state and input) are represented using capital letters, e.g. X;U. Sets are represented using upper case letter, e.g. P;O. Members of sets and spaces are represented using lower case italics, e.g. x; u; v. Convex polytopes are represented as uppercase characters, e.g. P;O. Problem descriptions (mathematical programs) will use uppercase characters, e.g. P.
- The slave dynamics are represented using a non-linear, time-invariant discrete-time System:

$$\chi^{+}=f(\chi,u), \tag{2.1}$$

where $\chi\in\Re^{n}$ is the current state of the system, $u\in R^{m}$ is the current input and $\chi^{+}$is the successor state. The state at time-step k is denoted $\chi_k$.

- The slave manipulator has constraints on the states and the inputs, which, in general, are mixed. The admissible set of inputs and states satisfy:

$$(\chi,u)\in\mathcal{P}\subset\mathbb{X}\times\mathbb{U} \tag{2.2}$$

where $X\subset\Re^{n}$ is the set of admissible states and $U\subset\Re^{m}$ is the set of admissible inputs. The obstacle set $\mathcal{O}\subset X$ is a mapping from $C_{obs}$ to the state space, in which it is desired that the state evolution never enters:

$$\chi_k\notin\mathcal{O},\ \forall k=1,2, \tag{2.3}$$

A formal definition of $\mathcal{O}$ is $$\mathcal{O}:=\{\chi\in\mathbb{X}:C_p(\chi)\in C_{obs}\}, \tag{2.4}$$

where $C_p(\cdot)$ maps the state space into a configuration of the slave manipulator. Correspondingly, the representation of obstacle $C_j$ within the state space is:

$$\mathcal{O}_j=\{\chi\in\mathbb{X}:C_p(\chi)\in\mathcal{C}_j\}, \tag{2.5}$$

and the approximation of each set is given respectively by $\hat{C}_j$ and $\hat{O}_j$. For the examples in this description, several of the states make up the configuration space, hence $C_p(\chi)=C_p\chi$ where $C_p$ is an appropriately sized matrix. $\mathcal{O}_i$ is used to represent part of the obstacles set the is represented by a convex polytope, such that $\mathcal{O}\subseteq\cup_i\mathcal{O}_i$

- $X_T$ is a positively invariant set and $\kappa\cdot(:)$ an associated feedback control law that must meet the following invariance and admissibility conditions (Blanchini 1999):

$$\forall\chi\in X_T,\ f(\chi,\kappa(\chi))\in X_T,$$

$$\forall\chi\in X_T,\ (\chi,\kappa(\chi))\in\mathcal{P}.$$

- The sequence of inputs generated by the operator, $\{\tilde{u}_0, \tilde{u}_1, \ldots \tilde{u}_n\}$ is denoted by $\tilde{u}_N$. The infinite sequence of future inputs $\{\tilde{u}_0, \tilde{u}_1, \ldots\}$ is denoted by $\tilde{u}_\infty$. -The OAF algorithm computes a sequence of alterations $\{v_0, v_1 \ldots v_n\}$ is denoted by $v_n$. The infinite sequence, $\{v_0, v_1 \ldots\}$ is denoted by $v_\infty$.

2.2 The Optimal Avoidance Filter Algorithm

The OAF algorithm calculates an additive alteration $v_k$, to the command provided by the operator $\tilde{u}_k$, to determine the filtered system input $$u_k=\tilde{u}_k+v_k, \tag{2.6}$$

such that (i) collisions with obstacles are avoided ($\chi_{k+i}\notin\mathcal{O}$), and (ii) the system constraints are satisfied ($(\chi_{k+i};u_{k+i})\in\mathcal{P}$), now and for all future time steps (i>=0). Additionally, the OAF algorithm minimizes the alterations to the operator command by costing the alterations using an appropriate norm. As posed, this problem is acausal, since the future operator input sequence $\{\tilde{u}_0, \tilde{u}_1, \ldots\}$ is unknown.

The OAF mathematical program $P_N(\chi, \tilde{u})$, which is solved online in a receding horizon fashion, accounts for constraints as it is derived from an N-step constrained optimal control problem, and causality is obtained by using an appropriate model to predict future operator inputs. The terminal state of the OAF mathematical program is constrained to enter a collision-free positively invariant set, $\chi_T$:

$$\chi_N\in X_T, \tag{2.7}$$

to obtain, using standard results in receding horizon control literature (Mayne et al. 2000, Rossiter 2003), a guaranteed stable (Mayne et al. 2000), and recursively feasible (Rossiter 2003) receding horizon controller. The obstacle avoidance constraints incorporated into the OAF mathematical program are $$\chi_k\notin\mathcal{O},\ \forall k=0,\ldots,N, \tag{2.8}$$

$$X_T\cap\mathcal{O}=\emptyset \tag{2.9}$$

The operator command prediction model used holds the current operator's command constant over the planning horizon, and sets the command input to be zero for k>N:

$$\tilde{u}_{k+i}=\tilde{u}_k,\ i=1,\ldots N-1, \tag{2.10}$$

$$\tilde{u}_{k+i}=0,\ i\geq N. \tag{2.11}$$

The invariant set feedback control law is then considered to be an alteration:

$$v_k=\kappa(\chi_k),\ \forall k>N. \tag{2.12}$$

In this prediction model, the likelihood that the prediction is correct decreases into the future. This attribute can be included in the formulation of $P_N$ by discounting the cost function:

$$v_{N-1}=\underset{v}{\operatorname{argmin}}\sum_{k=0}^{N-1}\gamma^k\|v_k\|, \tag{2.13}$$

where $0\leq\gamma\leq1$ is the discount factor. The resulting OAF mathematical program $P_N(\chi, \tilde{u})$, can be posed as:

$$v_{N-1}=\underset{v}{\operatorname{argmin}}\sum_{k=0}^{N-1}\gamma^k\|v_k\| \tag{2.14}$$

$$x_{k+1}=f(x_k,\tilde{u}+v_k),\quad \forall k=0,\ldots,N-1 \tag{2.15}$$

$$(x_k,\tilde{u}+v_k)\in\mathcal{P},\quad \forall k=0,\ldots,N-1 \tag{2.16}$$

$$x_k\notin\mathcal{O},\quad \forall k=1,\ldots,N-1 \tag{2.17}$$

$$x_N\in\chi_T, \tag{2.18}$$

$$\chi_T\cap\mathcal{O}=\phi. \tag{2.19}$$

The OAF algorithm is implemented by at each time step by:

1. Measuring the current state, $\chi_k$, and the current operator command input, $\tilde{u}_k$.
2. Solving the OAF mathematical program $P_N(\chi, \tilde{u})$, to obtain the sequence of alterations, $v_{N-1}$.
3. Setting the first element of $v_{N-1}$, to be $v_k$.
4. Sending the filtered input command, $u_k=\tilde{u}_k+v_k$, to the slave device.

3 The OAF for Convex Polytopal Obstacles

Let the obstacle set, $\mathcal{O}$, be composed of $N_O$ convex polytopes:

$$\mathcal{O}=\bigcup_{j=1}^{N_O}O_j. \tag{3.1}$$

Figure 3:
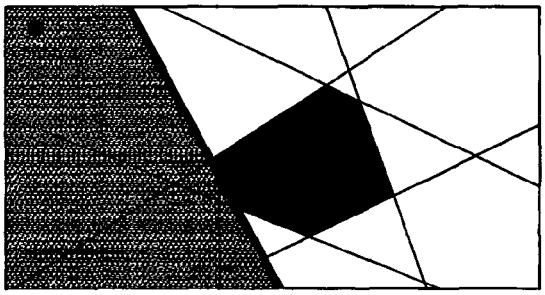
FIG. 3 illustrates a convex polytopal obstacle (black), made up from intersection of half spaces. The shaded area indicates the feasible region when a bold obstacle avoidance constraint is active (its corresponding □ =0). The state (black dot), x, is shown to be in the feasible region.

Each $\mathcal{O}_j$ can be described as the intersection of $N_h$ (finite) open half-spaces as shown in FIG. 3. That is $$O_j=\bigcap_{j=1}^{N_h(O_j)}\{x\in\mathbb{X}:a_{i,j}^Tx<b_{i,j}\}. \tag{3.2}$$

Noting that $\{\chi:-a_{i,j}^T\chi\leq-b_{ij}\}$ is the complement of $\{\chi:-a_{i,j}^T\chi<b_{ij}\}$, the obstacle avoidance constraint $\chi\notin O_j$, can be represented as:

$$x\in\bigcap_{i=1}^{N_h(O_j)}\{x\in\mathbb{X}:-a_{i,j}^Tx\leq-b_{i,j}\}. \tag{3.3}$$

Equation 3.3 is non-convex and can also be expressed as a collection of OR (written $\vee$) constraints:

$$[-a_{1j}\chi\leq-b_{1j}]\vee[-a_{2j}\chi\leq-b_{2j}]\vee\ldots\vee[-a_{N_h(O_j)j}x\leq-b_{N_k(O_j)j}]. \tag{3.4}$$

This structure is exploited in (Richards 2002, Kuwata 2003) where Eqn. 3.4 is transformed into a set of mixed-integer linear inequalities using the so-called big-M method (Bemporad & Morari 1999, Mignone 2001) by introducing a scalar M, such that $$\mathbb{X}\subseteq\{102\in\mathfrak{R}^n:-a_{i,j}^T\chi\leq-b_{i,j}+M\},\ \forall i,j, \tag{3.5}$$

and a binary decision variable ($a_{ijk}$) for each of the half-spaces in $O_j$. The resulting mixed-integer linear inequalities are:

$$-a_{i,j}^Tx\leq-b_{i,j}+M\alpha_{i,j,k},\quad \forall i=1,\ldots,N_h(O_j), \tag{3.6}$$

$$\sum_{j=1}^{N_h(O_j)}\alpha_{i,j,k}\leq N_h(O_j)-1, \tag{3.7}$$

$$\alpha_{i,j,k}\in\{0,1\},\quad \forall 1,\ldots,N_h(O_j). \tag{3.8}$$

where k represents the prediction time step in $P_N$. When a constraint is active $\alpha=0$; when inactive $\alpha=1$. Equation 3.5 ensures that when a constraint is inactive, $\mathbb{X}$ is a subset of the half-space induced by the constraint. Equation 3.7 ensures that the obstacle avoidance constraints for $O_j$ (Eqns. 3.6 to 3.8) are satisfied by forcing at least one of the avoidance constraints of $O_j$ to be active. If the slave dynamics are linear, its system constraints polytopal, and the obstacle set, O, made up of polytopal obstacles, then the OAF can be posed as the following MIP:

$$v_{N-1}=\underset{v}{\operatorname{argmin}}\sum_{k=0}^{N-1}\gamma^k\|v_k\| \tag{3.9}$$

$$x_{k+1}=Ax_k+B(\tilde{u}_k+v_k),\quad \forall k=0,\ldots,N-1 \tag{3.10}$$

$$(x_k,\tilde{u}_k+v_k)\in\mathcal{P},\quad \forall k=0,\ldots,N-1 \tag{3.11}$$

$$a_{ij}x_k\leq b_{i,j}+M\alpha_{i,j,k},\quad \forall i=1,\ldots,N_h(O_j),\quad \forall j=1,\ldots,N_o,\quad \forall k=1,\ldots,N-1 \tag{3.12}$$

$$\sum_{i=1}^{N_h(O_j)}\alpha_{i,j,k}\leq N_h(O_j)-1,\quad \forall j=1,\ldots,N_o,\quad \forall k=1,\ldots,N-1 \tag{3.13}$$

$$x_N\in\chi_T, \tag{3.14}$$

$$\chi_T\cap\mathcal{O}=\phi, \tag{3.15}$$

given that an appropriate norm is chosen for Eqn. 3.9. The solution of Eqns. 3.9 to 3.15 is NP-hard (Floudas 1995), with a worst-case bound on the computational cost that is exponential in the number of binary decision variables:

$$(N-1)\sum_{j=1}^{N_o} N_h(O_i). \tag{3.16}$$

Equation 3.16 does not include the additional binary variables required to represent the invariant set obstacle avoidance constraint (Eqn. 3.15), as this depends on the choice of invariant set. This additional number may range from zero, for a fixed invariant set ($X_T \subset \mathbb{X}/\mathcal{O}$), to a number that is arbitrarily large for an invariant set parameterized by $\chi_N$.

3.1 Using Axial-Aligned Bounding Boxes to Represent Obstacles

In previous work, Kuwata & How (2004), Richards (2005), Richards et al. (2003) have used axially-aligned bounding boxes (abbreviated as ABBs) to represent (or bound) obstacles, or parts thereof. An ABB is represented by the maximum and minimum bounds in each axis of the obstacle:

$$B_j := [\chi_{min,j}, \chi_{max,j}] \times [\mathcal{Y}_{min,j}, \mathcal{Y}_{max,j}] \times \tag{3.17}$$

The mixed-integer inequalities for the avoidance of an ABB obstacle are given by:

$$x \le x_{min,j} + M\alpha_{1,j,k} \tag{3.18}$$

$$-x \le -x_{max,j} + M\alpha_{2,j,k} \tag{3.19}$$

$$y \le y_{min,j} + M\alpha_{3,j,k} \tag{3.20}$$

$$-y \le -y_{max,j} + M\alpha_{4,j,k} \tag{3.21}$$

$$\ldots$$

$$\sum_{i=1}^{2N_D} \alpha_{i,j,k} \le 2N_D - 1 \tag{3.22}$$

where $N_D$ is the number of dimensions in which the obstacle is defined (usually 2D or 3D). $2N_D$ binary variables are required for each ABB-obstacle.

Extension to Non-Convex Obstacles Using Bounding Volume Hierarchies

One strategy that extends the OAF to avoid non-convex obstacles is to convexify them, and avoid the resulting convex representation. The two most common convex representations for non-convex obstacles are the convex decomposition and the convex hull. The convex decomposition represents a non-convex obstacle as a number of convex regions $P_{i,j}$, such that $\mathcal{O}_j = \cup P_{ij}$, $\forall j$, and the convex hull of an obstacle is the smallest convex set that contains the obstacle. A major downside of using a convex decomposition of the object is that it contains a lot of detail, hence it is computationally expensive representation, while the convex hull representation, although computationally less expensive, does not allow the slave to move within concavities of the non-convex obstacle. Schouwenaars (2006) has modified the convex hull representation to include convex polytopal safe zones within the convex hull that allow movement into the concavities, but this increases the complexity of the representation. Furthermore each of these representations are static, and consequently may not be the most efficient representation in a given situation (as represented by the state, command input pair).

Figure 4:
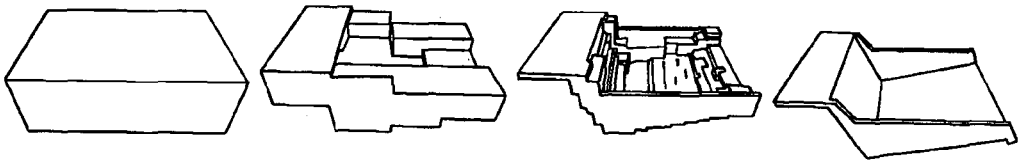
FIG. 4 illustrates a different level of detail representation for a haul truck tray.

The preferred embodiment utilises a level-of-detail approach for avoiding non-convex obstacles which utilizes representations drawn from bounding volume hierarchies of each obstacle. FIG. 4 illustrates this idea showing several different level of detail representations of a haul truck tray, from coarsest to finest. The appropriate level-of-detail representation of the obstacle set is chosen such that the cost of computing the alteration vk is reduced when compared to using the highest detail representation available, while not significantly changing the resulting alteration. It is necessary to 'trade-off' between these two objectives.

4.1 Representation of Non-Convex Obstacles Using Bounding Volume Hierarchies

Figure 5:
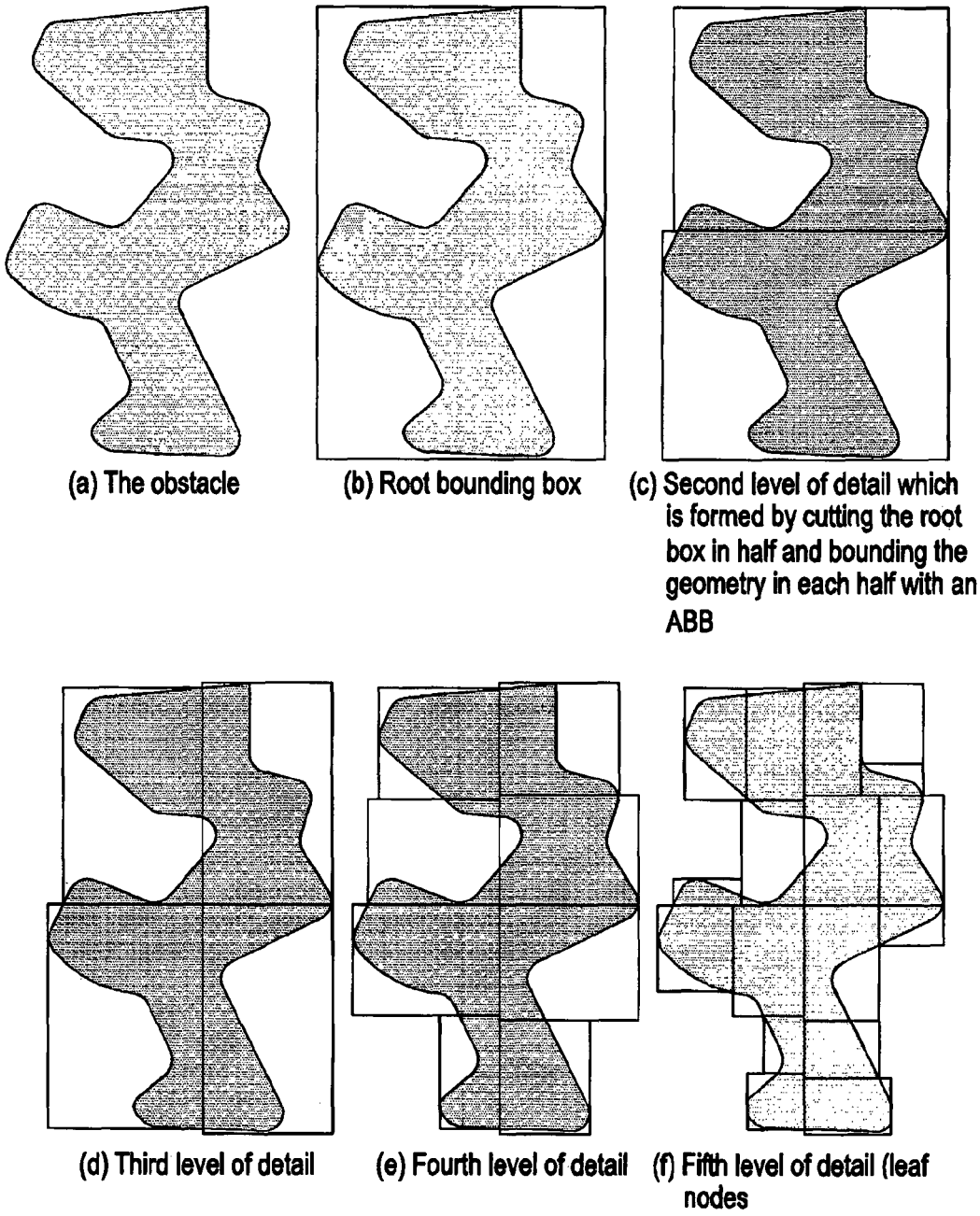
FIG. 5 illustrates the construction of an axially-aligned bounding box hierarchy of a 2D non-convex object.
Figure 6:
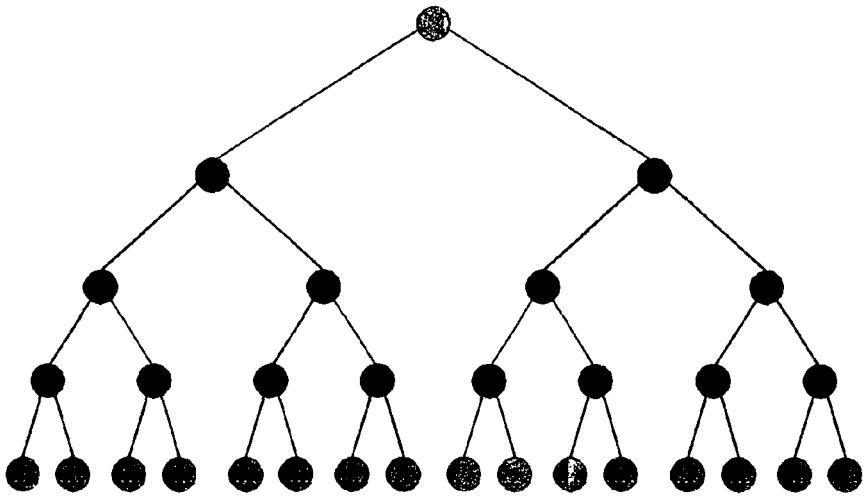
FIG. 6 illustrates an axial-aligned bounding box BVH—based on the example in FIG. 5.

In prior work, BVH's have been used to determine whether arbitrary geometric models of objects intersect (Gottschalk et al. 1996, Cohen et al. 1995). A BVH is constructed by recursively bounding and partitioning the geometry of an obstacle and storing the resulting bounding volumes in a binary tree (Gottschalk et al. 1996). This construction is initiated by determining an ABB (or another chosen volume) that bounds the entire obstacle. This box is the root box (ABB) of the obstacle. The geometry of the obstacle is then subdivided along the centre of the longest side of the root ABB into two sub-geometries, which are in turn bounded with an ABB and stored in the binary tree. This 'bound-and-split' process is recursively applied to the leaf boxes of the BVH until either a minimum geometry size is achieved or further recursion does not improve precision. FIGS. 5 and 6 shows the construction of a BVH for an arbitrary closed 2D obstacle. ABBs are chosen because they are simple and lead to efficient Minkowski sum operations (Smith 2008). BVHs composed of oriented bounding boxes (Gottschalk et al. 1996) could also be used as an alternative level-of-detail representation. A union the ABBs selected from the BVH of a specific obstacle ($\mathcal{O}_j$) must be a superset of that obstacle, specifically a cover.

Definition A cover $\hat{\mathcal{O}}_j$ is a collection of boxes, B, from the BVH of $\mathcal{O}_j$, such that:

$$\hat{O}_j = \bigcup_{(l,m)\in I_j} B_{l,m} \supseteq O_j, \tag{4.1}$$

where l indicates the level of detail (starting with 1 for the root node), and m indicates the node within the level. $B_{l;m}$ is a particular box within the BVH. The index set, $I_j$, indicates which boxes from the BVH are included in the cover representing $\mathcal{O}_j$. A further requirement is that no superfluous boxes should be included in the cover, i.e. boxes that can be removed where the remnant remains a cover. If this requirement holds, the cover is minimal. A minimal cover of an obstacle is a cover such that if any of the boxes (ABBs) are removed, it is no longer a cover. The non-convex OAF algorithm will choose a minimal cover as the representation for each obstacle, based upon the current state and operator command. The following proposition allows for the synthesis of minimal cover selection algorithms that recurse down the BVH:

Proposition 4.1 There is a single member of the minimal cover on each branch of the tree (path from root box to a particular leaf box).

The leaf boxes of the BVH form a partition of the obstacle:

$$O_j = \bigcup_{m=1}^{2^{N_L-1}} \mathcal{G}(B_{N_L,m})$$

where $\mathcal{G}$ (.), is the geometry that is bounded by a given box, and $\mathcal{G}(B_{N_L,m1}) \cap \mathcal{G}(B_{N_L,m2}) = \emptyset$, $\forall m_1 \neq m_2$. The geometry in each of the leaf boxes is only bounded by its ancestor boxes, i.e. $\mathcal{G}(B_{N_L,m}) \subseteq B_l$, $\forall l = 1, \ldots, N_L - 1$ only, where (.) indicates the appropriate ancestor box for each level. These boxes are found on the branch of the tree that goes from the root box to the given leaf box. Hence, to cover the entire obstacle, it is necessary for boxes on each branch of the tree to be included in the cover. If there is more than one box on a branch, then the box that is a descendant of the other box is superfluous and can be removed. The minimal cover can be chosen in two ways: implicitly as part of the optimization solution or explicitly using a static or adaptive rule. Approaches to each are now considered.

4.2 Implicit Non-Convex OAF

In the implicit non-convex OAF algorithm, the entire BVH is included in the OAF MIP and the coarsest minimal cover that is feasible with respect to the optimal trajectory is selected during the optimization. The selection of the minimal cover is incorporated into the OAF MIP by allocating minimal cover-selection binary decision variables $\delta_{l,m,k}\in\{0,1\}$, to each box in the BVH that has children, and by adding a minimal cover selection function (logic) for each box, $\beta_{l,m}(\delta_{l,m,k})$ to the right-hand side of the constraint relaxation inequality (3.22), $$\sum_{i=1}^{2N_D}\alpha_{i,j,k}\le 2N_D-1+\beta_{l,m}(\delta_k), \tag{4.2}$$

where $\delta_k$ is the vector of minimal cover selection binary variables for time k. The minimum cover selection function determines whether the box is in the minimal cover based on $\delta_k$: If $\beta_{l,m}(\delta_k)=0$, the box is a member of the minimal cover; if $\beta_{l,m}(\delta_k)\ge 1$, it is not. For $\beta_{l,m}(\delta_k)=1$, the constraint relaxation inequality becomes:

$$\sum_{i=1}^{2N_D}\alpha_{i,j,k}\le 2N_D, \tag{4.3}$$

allowing all of the avoidance constraints for the box to be relaxed to the entire constraint set. The OAF objective function is modified by placing a small cost on the minimal cover binary decision variables such that finer detail will only be selected if a reduction of the trajectory cost (the unmodified objective function) results. The minimal cover selection function for each box is composed of an ancestor minimal cover selection function, $\beta_{l,m}(\delta_k)\ge 0$ and a descendent minimal cover selection function, $\bar{\beta}_{l,m}(\delta_k)\ge 0$, both of which must equal zero if the box is in the minimal cover. The minimal cover selection function becomes:

$$\beta_{l,m}(\delta_k)=\bar{\beta}_{l,m}(\delta_k)+\tilde{\beta}_{l,m}(\delta_k) \tag{4.4}$$

The ancestor component ensures that the box can only be a member of the minimal cover if none of its ancestors are in the minimal cover (by Proposition 4.1). The descendent component determines whether the box, or some of its descendants are part of the minimal cover, given that $\bar{\beta}_{l,m}(\delta_k)=0$. The descendant minimal cover selection algorithm for boxes with children is given by:

$$\tilde{\beta}_{l,m}(\delta_k)=\delta_{l,m,k}. \tag{4.5}$$

The box may be selected for the minimal cover (dependant on the ancestor part of the selection function) if $\delta_{l,m,k}=0$, and if $\delta_{l,m,k}=1$, $B_{l,m}$ will be relaxed in favor of its descendants. By Proposition 4.1, $\bar{\beta}_{NL,m}(\delta_k)=0$ for the leaf boxes of the BVH, since if none of the ancestors of a leaf box are in the minimal cover, then the leaf box must be in the minimal cover. The ancestor minimal cover selection function is given by:

$$\bar{\beta}_{l,m}(\delta_k)=\sum_{p=1}^{l-1}(1-\delta_{p,\cdot,k}), \tag{4.6}$$

where (.) indicates the appropriate ancestor box (which can be determined by recursing up the BVH via the parent relationship) of $B_{l,m}$. If all of the ancestor boxes of $B_{l,m}$ are not in the minimal cover (i.e. $\delta_{p,\cdot,k}=1;\forall p)\bar{\beta}_{l,m}(\delta_k)=0$. and $B_{l,m}$ may be in the minimal cover. If one of the ancestors of $B_{l,m}$ is in the minimal cover, $\bar{\beta}_{l,m}(\delta_k)\ge 1$ and $B_{l,m}$ cannot be in the minimal cover. Note $\bar{\beta}_{l,m}(\delta_k)=0$ for the root box as it has no ancestors. The minimum cover selection functions for the boxes in a BVH with $N_L$ detail levels are given by:

$$\beta_{1,1}(\delta_k)=\delta_{1,1,k}, \tag{4.7}$$

$$\beta_{l,m}(\delta_k)=\delta_{l,m,k}+\sum_{p=1}^{l-1}(1-\delta_{p,\cdot,k}), \tag{4.8}$$

$$\forall m=1,\ldots,2^{l-1},\ \forall l=2,\ldots,N_L-1,$$

$$\beta_{N_L,m}(\delta_k)=\sum_{p=1}^{N_L-1}(1-\delta_{p,\cdot,k}),\ \forall m=1,\ldots,2^{N_L-1} \tag{4.9}$$

The OAF objective function (Eqn. 3.9) is modified so that it selects the coarsest minimal cover that is feasible with respect to the minimum cost trajectory. This is achieved by costing the relaxation of a box in favor of its descendants, which is implemented by placing a small cost $\epsilon>0$, on each of the minimum cover selection binary decision variables. This causes the MIP solver to choose finer detail only if the trajectory cost will be reduced as a result. The modified objective function is:

$$v_{N-1}=\underset{v}{\operatorname{argmin}}\sum_{k=0}^{N-1}(\gamma^k\|v_k\|+\epsilon 1^T\delta_k), \tag{4.10}$$

where 1 is a column vector of ones of an appropriate size, and $0<\gamma\le 1$ is the discounted rate.

The implicit version of the finite horizon obstacle avoidance problem ($P_{imp}(x_0;,\tilde{u}_{N-1}.)$) is:

$$v_{N-1}=\underset{v}{\operatorname{argmin}}\sum_{k=0}^{N-1}(\gamma^k\|v_k\|+\epsilon 1^T\delta_k), \tag{4.11}$$

$$x_{k+1}=Ax_k+B(\tilde{u}_k+v_k),\ \forall k=0,\ldots,N-1 \tag{4.12}$$

$$(x_k,\tilde{u}_k+v_k)\in\mathcal{P},\ \forall k=0,\ldots,N-1 \tag{4.13}$$

$$a_{i,l,m}x_k\le b_{i,l,m}+M\alpha_{i,l,m,k},\ \forall i=1,\ldots,2N_D, \tag{4.14}$$

$$\forall m=1,\ldots,2^{l-1},\ \forall l=1,\ldots,N_L,\ \forall k=1,\ldots,N-1$$

$$\sum_{i=1}^{2N_D}\alpha_{i,l,m,k}\le 2N_D-1+\beta_{l,m}(\delta_k), \tag{4.15}$$

$$\forall m=1,\ldots,2^{l-1},\ \forall l=1,\ldots,N_L,\ \forall k=1,\ldots,N-1$$

$$x_N\in\chi_T, \tag{4.16}$$

$$\chi_T\cap\mathcal{O}=\emptyset, \tag{4.17}$$

where $\beta_{l,m}(\delta_k)$ is given by the appropriate selection function in Eqns. 4.7-4.9. The implicit non-convex OAF algorithm, given by solving Eqns. 4.11-4.17 in a receding horizon fashion, is recursively feasible (Rossiter 2003), as the same minimal cover can always be chosen by the MIP solver at the next time step. A single minimal cover for the entire prediction horizon can be chosen by using only one set of minimal cover selection decision variables and using these for the minimal cover selection functions at each prediction step.

4.3 Explicit Non-Convex OAF

The explicit non-convex OAF algorithm operates by:

1. selecting an appropriate minimal cover from the BVH for each obstacle using a static rule or a adaptive algorithm based on the current state and/or operator command, then
2. solving the OAF for convex polytonal obstacles (Section 3),treating the boxes in the minimal cover(s) as convex obstacles.

A static minimal cover selection rule could be to choose either the finest minimal cover, which is made up of all the leaf boxes in the BVH (denoted leaf boxes OAF), or the minimal cover that requires the least number of binary variables to represent it, i.e. the root box only (denoted root box OAF). A simple adaptive minimal cover selection algorithm would be to switch between the leaf boxes and root box minimal cover representations for an obstacle depending on the current distance to the obstacle. A more sophisticated adaptive minimal cover selection algorithm can be synthesized by examining the structure of the solution of PN. The optimizer selects the minimum-cost feasible trajectory over the prediction horizon as the solution of PN. As the objective function costs deviations from the operator command, the minimum-cost feasible trajectory is likely to be spatially close to the nominal trajectory:

Definition The nominal trajectory $\tilde{T}_N(xk; \tilde{u}_k)$, is defined as the predicted trajectory over an N-step horizon that will occur if the operator's command is held constant over the N-step horizon (vN-1=0, hence zero-cost):

$$\tilde{T}_N(\chi_k, \tilde{u}_k)=\{\tilde{\chi}_k, \tilde{\chi}_{k+1}, \ldots, \tilde{\chi}_{k+N}\},$$

where ~$\tilde{\chi}$k=xk and $\tilde{\chi}$j+1=f($\tilde{\chi}$j; ũk).

Hence, an appropriate minimal cover selection rule may be to choose fine detail for the parts of the obstacles that are close to the nominal trajectory and coarse detail for parts of the obstacles far away from the nominal trajectory. As the nominal trajectory is defined for the horizon, a single minimal cover will be used over the prediction horizon. A minimal cover selection rule that apportions fine detail near the nominal trajectory and coarse detail elsewhere can be implemented efficiently by recursing down the BVH of each obstacle. The desired minimal cover (i) will contain the smallest number of ABBs such that any leaf boxes that intersect with the nominal trajectory are included, or (ii) if the trajectory does not intersect with any of the leaf boxes, the coarsest minimal cover that does not intersect with the nominal trajectory will be chosen. The implementation of the minimal cover selection rule involves recursing down each branch of the BVH until a leaf box or a box that does not intersect with the nominal trajectory is found and added to the minimal cover. Further recursion to such a box's children (if any) is halted due to Proposition 4.1. This approach is hereafter called the nominal trajectory minimal cover selection algorithm, see Alg. 1, and the OAF algorithm utilizing this selection rule to select minimal covers for each obstacle is called the nominal cover OAF algorithm.

Algorithm 1: recurseNomTraj($B_{l,m}$, $\tilde{T}_N(x_k,\tilde{u}_k)$)

```
Data: ABB: B_{l,m}; nominal trajectory: T̃_N(x_k, ũ_k)
Result: Nominal Trajectory Minimal Cover, Ô_j
if B_{l,m} is a leaf node then
    append B_{l,m} to Ô_j
    Ô_j = Ô_j + B_{l,m};
else
    if B_{l,m} ∩ T̃_N(x_k, ũ_k) = ∅ then
        append B_{l,m} to Ô
        Ô_j = Ô_j + B_{l,m};
    else
        recurse to Children
        ∀ children to B_{l,m} : B_{l+1,p}, recurseNomTraj(B_{l+1,p}, T̃_N(x_k, ũ_k));
```

Figure 7:
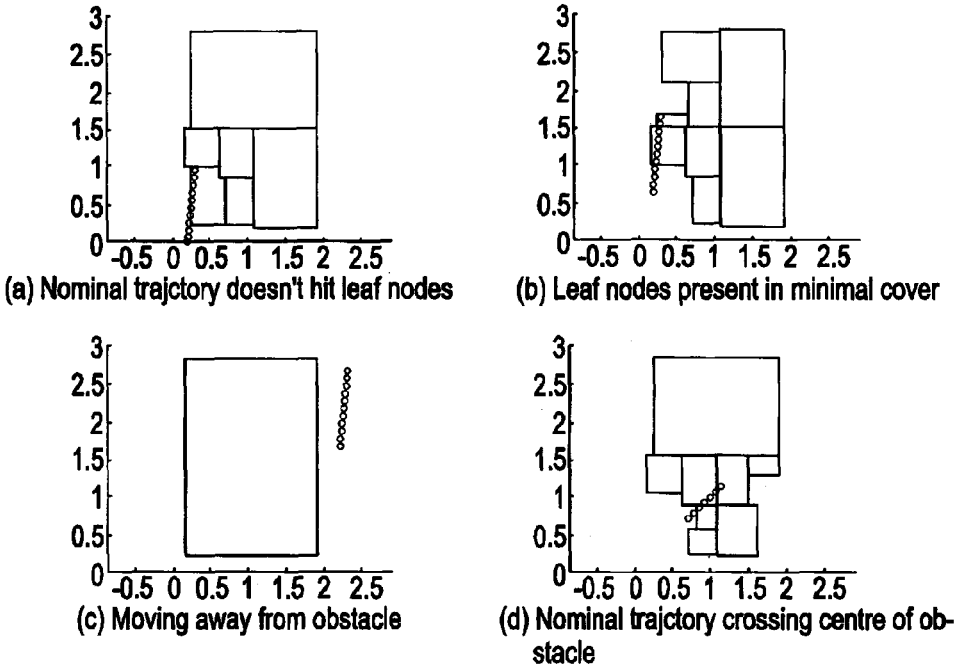
FIG. 7 illustrates examples of minimum covers generated using the nominal trajectory for different state, command input pairs. The nominal trajectory is given by circles and current position by the square.

FIG. 7 presents minimal covers for the obstacle given in FIGS. 5 and 6 that are generated by four different state, operator command pairs using Alg. 1. Each nominal trajectory is represented by the joined circles and the current position is shown by the square. FIG. 7(*a*) shows the minimal cover when the current position is external to the root box and the nominal trajectory does not intersect with any leaf boxes, i.e. the coarsest minimal cover that does not intersect with the nominal trajectory. The minimal cover produced in FIG. 7(*b*) includes leaf boxes that the nominal trajectory intersects with, and the minimum amount of boxes required to cover the remainder of the object. FIG. 7(*c*) shows that the minimal cover is the root box when the slave state is outside the root box and the nominal trajectory does not intersect with the root box. FIG. 7(*d*) shows a potential drawback to the nominal trajectory minimal cover selection algorithm.

Here the nominal trajectory crosses the centerline of the object and includes fine detail on the opposite side of the obstacle in the minimal cover. The inclusion of finer detail on the opposite side of the obstacle in the minimal cover is unlikely to improve the trajectory, or in particular, reduce the magnitude of the first alteration, compared to a minimal cover that has a coarser representation for the far side of the obstacle. This additional detail will increase the computational cost of solving the resulting MIP.

Algorithm 2 shows the operation of the explicit non-convex OAF algorithm. getMinimalCover( )calls the appropriate static or adaptive rule that chooses the minimal cover for each object at each time step, e.g. all leaf nodes, or the nominal trajectory minimal cover (Alg. 1).

Algorithm 2: Explicit non-convex OAF

```
Data: current state x_k, current operator command û_k, obstacle ABB-Tree
  root node B_{1,1}
Result: operator modification v_k
Ô = get MinimalCover( )
Set up standard OAF problem with Ô as obstacles
Add Ô to P_N as obstacles
Solve OAF problem
v_{N-1} ← solution of P_N
Select first input modification
Return v_k
```

4.3.1 Recursive Feasibility of Nominal Trajectory Explicit OAF

The constraint set of the nominal trajectory non-convex OAF potentially changes at each time step. As a result, standard recursive feasibility conditions as set down, for example in (Rossiter 2003), do not hold. We now provide conditions under which recursive feasibility holds for changing obstacle constraint sets. The obstacle representation at time k is denoted, $\mathcal{O}_k$, and is a superset of the obstacle set $\mathcal{O}$. It is assumed that there is a feasible trajectory at time step k, $$T_k=\{\chi_k,\chi_{k+1},\ldots,\chi_{k+N}\}\cup X_T.$$

A trajectory at time k+1 can be constructed that is a subset of $T_k$ (assuming the deterministic case), $$T_{k+1}=\{\chi_{k+1},\chi_{k+2},\ldots,\chi_{k+N},f(\chi_{k+N},N(\chi_{k+N}))\}\cup X_T.$$

A limited recursive feasibility condition is presented in the following proposition:

Proposition 4.2 Recursive feasibility holds for a changing obstacle set when the obstacle set is monotonically decreasing, i.e. $\mathcal{O}^{k+1}\subseteq\mathcal{O}^k$.

Proof: It is given that $T_k$ is feasible with respect to $\mathcal{O}^k$, i.e. $T_k\cap\mathcal{O}^k=\emptyset$. Since $T_{k+1}\subseteq T_k$ and $\mathcal{O}^{k+1}\subseteq\mathcal{O}^k$ then $T_{k+1}$ is feasible with respect to $\mathcal{O}^{k+1}$.

The downside of Proposition 4.2 is that it only allows for the obstacle representation set to be refined; it does not allow for the obstacle representation set to become coarser if the slave moves away from it. This limitation is addressed in Corollary 4.3.

Definition The a posteriorix obstacle set, $O(T_k)$, is defined as the coarsest level of detail obstacle representation set such that $\bar{\mathcal{O}}(T_k)\cap T_k=\emptyset$.

Corollary 4.3 Recursive feasibility holds for a changing obstacle set if the obstacle set at time k+1, $\mathcal{O}^{k+1}$, is a subset of $\bar{\mathcal{O}}(T_k)$.

Proof: Follows directly from the proof of Proposition 4.2. It is possible to incorporate the recursive feasibility conditions for $\mathcal{O}^{k+1}$ from Corollary 4.3 into the nominal trajectory minimal cover selection algorithm (Alg. 1) by enforcing recursion to the box's children when a box intersects with the solution trajectory from $P_N$ at the previous time step. This modification to Alg. 1, restricts the minimal cover at time k+1 to be a subset of $\mathcal{O}^k(T_k)$.

4.4 Evaluation of Explicit and Implicit Non-Convex OAF Algorithms

The alternative OAF algorithms are evaluated by comparing their performance in terms of computational cost and deviation from the nominal trajectory. The implicit OAF algorithm is evaluated against the leaf boxes OAF algorithm, and the nominal trajectory OAF algorithm is compared to both the leaf boxes and the root box OAF algorithms. The dynamic model used for the comparison simulations is that of a proportionally velocity-controlled point mass in two dimensions. The discretized dynamics ($T_s$=0.2 s) and constraints for each degree of freedom (chosen along x and y axes) are:

$$\begin{bmatrix} q_{k+1} \\ v_{q,k+1} \end{bmatrix}=\begin{bmatrix} 1 & 0.0865 \\ 0 & 0.135 \end{bmatrix}\begin{bmatrix} q_k \\ v_{q,k} \end{bmatrix}+\begin{bmatrix} 0.1135 \\ 0.865 \end{bmatrix}u_{q,k}, \tag{4.18}$$

$$q\in[-10,10],\ v_q\in[-1,1],\ u_q\in[-1,1],\quad 10(u_q-v_q)\in[-1,1]. \tag{4.19}$$

The invariant set used in this simulation is the zero-velocity invariant set, which is given, along with its associated terminal feedback control by:

$$X_T=\{[x,y,v_x,v_y]^T\in\mathbb{X}/\mathcal{O}:v_x=0,\ v_y=0\}, \tag{4.20}$$

$$u_{x,T}=0,\ u_{y,T}=0. \tag{4.21}$$

This invariant set is incorporated in the MIP OAF using the following constraints:

$$x_{k+N}\notin\mathcal{O}. \tag{4.22}$$

$$v_{x,k+N}=0,\ v_{y,k+N}=0,\ u_{x,k+N}=0,\ u_{y,k+N}=0. \tag{4.23}$$

Note that Eqn 4.22 will require obstacle avoidance constraints, analogous to those in remainder of the horizon, to be imposed for the terminal state, e.g. nominal trajectory or implicit avoidance constraints. The obstacle set and BVH for these simulations is the obstacle and BVH given, respectively, in FIGS. 5 and 6. The prediction horizon length is set to 1 sec (N=5). and a 2-norm cost will be placed on the deviation, and the discount rate γ=1. The resulting MIP formulation is a Mixed Integer Quadratic Program (MIQP), which can be solved using CPLEX (ILOG 2007).

Figure 8:
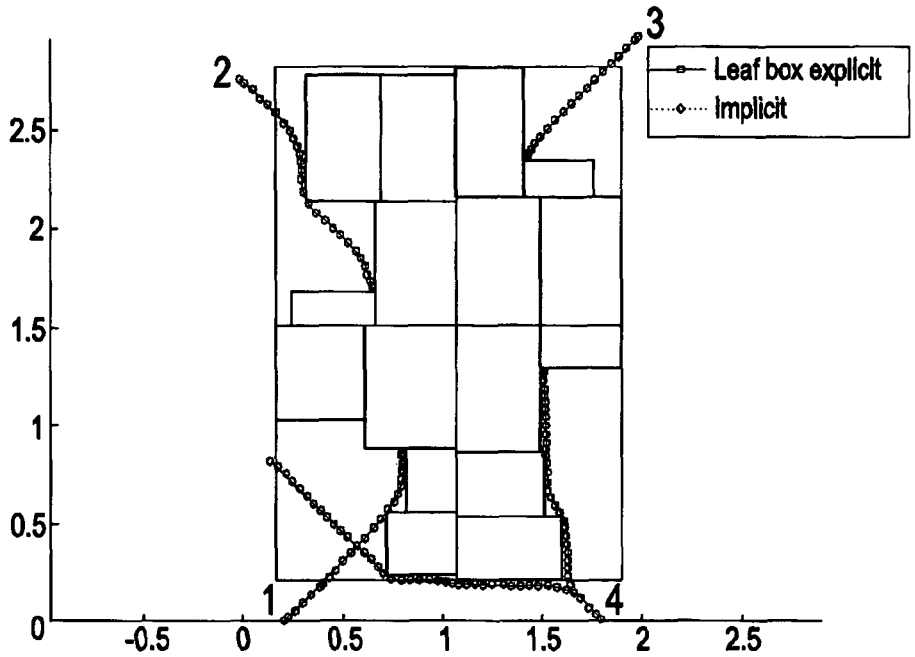
FIG. 8 illustrates a comparison of implicit and leaf boxes OAF algorithms from four different starting points and constant commands. The trajectories starting at points 1,2 and 3 stop within concavities of the obstacle in the direction commanded by the operator, while the trajectory from point 4 moves along the side of the obstacles before resuming following the command provided by the operator. In all four of these simulations, the trajectories produced by the leaf node OAF and the implicit OAF correspond.

FIG. 8 shows that the trajectory produced by the implicit OAF corresponds to the trajectory produced by the leaf box OAF. Since all minimal covers are supersets of leaf box minimal cover, and that the MIQP solver determines the global optimal solution to the MIP, the trajectories correspond due to Proposition 4.4:

Proposition 4.4 Consider two minimal covers: $\hat{\mathcal{O}}_1$ and $\hat{\mathcal{O}}_2$. If $\hat{\mathcal{O}}_1\subseteq\hat{\mathcal{O}}_2$, then cost of the optimal trajectory that is feasible with respect to $\hat{\mathcal{O}}_1$ is less than, or equal to the cost of the optimal trajectory that is feasible with respect to $\hat{\mathcal{O}}_2$.

Proof: Consider the set of all trajectories from a given state, χ, that are feasible with respect to the constraints and the minimal cover $\hat{\mathcal{O}}$.

$$T_N(\chi,\hat{\mathcal{O}})=\{T_N(\chi,u_{N-1}):\forall u_{N-1}\in\mathbb{U}^N,\ \text{subject to } T_N(\chi,u_{N-1})\cap\hat{\mathcal{O}}=\emptyset\}$$

Since $\hat{\mathcal{O}}_1\hat{\mathcal{O}}\subseteq_2$, all of the trajectories that are feasible with respect to $\hat{\mathcal{O}}_2$, are also feasible with respect to $\hat{\mathcal{O}}_1$, hence $T_N(\chi,\hat{\mathcal{O}}_2)\hat{\mathcal{O}}\ T_N(\chi,\subseteq_1)$, $\forall\chi\in\mathbb{X}$. So the cost for the minimum cost trajectory in $T_N(\chi,\hat{\mathcal{O}}_1)$ is less than, or equal to the cost for the minimum cost trajectory in $T_N(\chi,\hat{\mathcal{O}}_2)$.

This result is dependant on the appropriate choice of ϵ in Eqn. 4.11. If ϵ is larger than the cost difference between the leaf node trajectory and one for another minimal cover, then the implicit and leaf node trajectories will not correspond. The least computationally efficient algorithm of either the leaf boxes OAF or the implicit OAF is redundant, as they produce the same trajectory.

The table below shows simulation times (in seconds) for the different forms of the OAF for the different starting points. These simulations were run on an Intel Core 2 Duo E6300 (single core only) with 4 GB of RAM, where the OAF MIQP is solved using CPLEX10.2 (ILOG 2007).

| | 1 | 2 | 3 | 4 | Binary Variables |
|---|---|---|---|---|---|
| Root Box | 0.56 | 0.53 | 0.66 | 0.56 | 20 |
| Leaf Boxes | 15.09 | 15.13 | 14.44 | 12.66 | 320 |
| Nominal Trajectory | 3.67 | 2.86 | 3.16 | 3.37 | 20-320 |
| Implicit | 59 | 52.71 | 52.2 | 55.35 | 695 |

Figure 9:
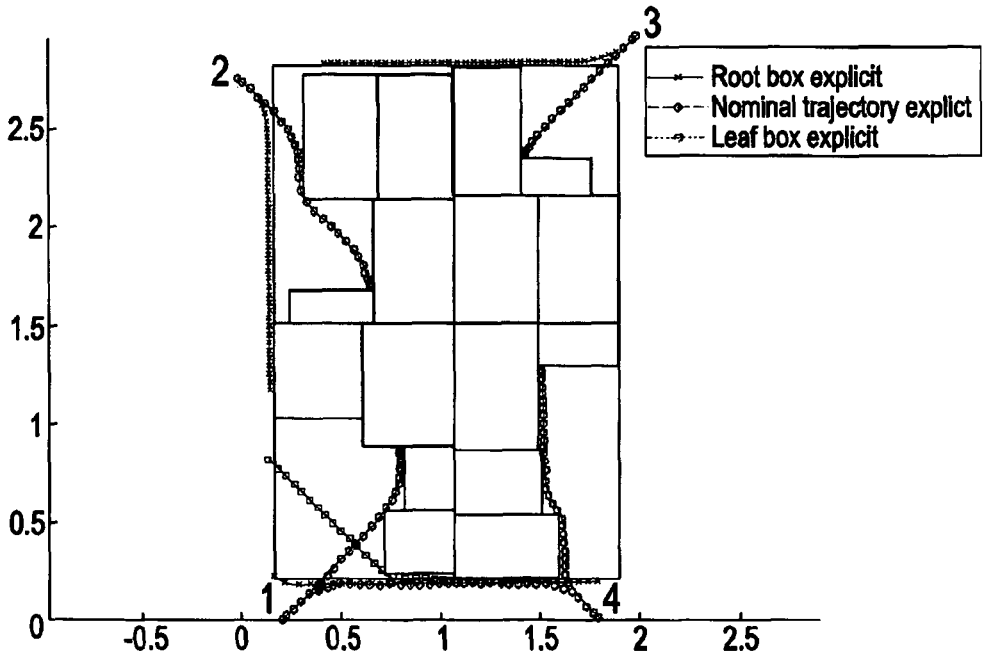
FIG. 9 illustrates nominal trajectory OAF compared to root box and leaf boxes OAFs from four different starting points and constant commands. Trajectories determined using nominal trajectory and leaf nodes OAF, starting from points 1,2 and 3, correspond. The trajectories starting at point 4 diverge due to the ordering of the branching in the MIP solution.
Figure 10:
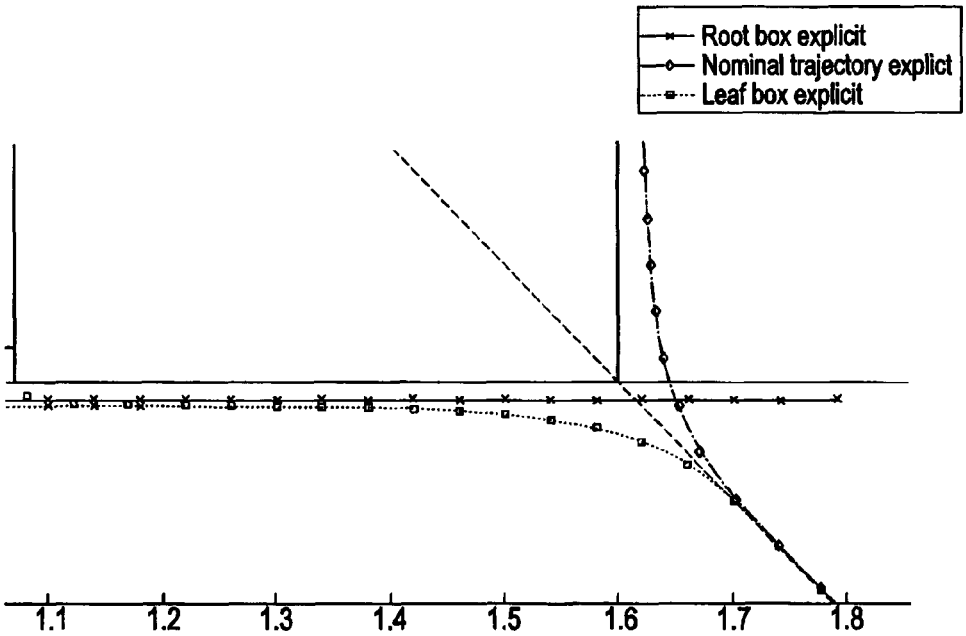
FIG. 10 illustrates the nominal trajectory OAF and leaf boxes OAF trajectories can be seen diverging. The dashed line, indicating the nominal path, shows that at the point of divergence the cost of diverting to the left and right were equal.

The table shows that for the four trajectories considered in FIG. 8, the computation of the leaf boxes trajectory takes approximately 30% of the time taken to compute the implicit OAF trajectory. This comparison renders the implicit OAF formulation redundant. Two reasons for the poor performance of the implicit OAF are that (i) it is computing the best minimal cover in addition to the optimal trajectory, and (ii) the leaf node OAF is a subproblem of the implicit OAF. The nominal trajectory explicit OAF is to be verified by comparing its trajectories against those produced by the leaf boxes OAF and the root box OAF. The nominal trajectory OAF is formulated to produce a lower deviation trajectory than the root node OAF, and (ii) be more computationally efficient on average than the leaf boxes OAF. The simulations verify this supposition. In three of the four simulations shown in FIG. 9, the trajectories produced by the leaf boxes OAF and the nominal trajectory OAF correspond, while in the fourth, the leaf boxes OAF and the nominal trajectory OAF diverges due to the order of branching in the MIQP solver when the minimum-cost trajectory is not unique (see FIG. 10). Additionally, divergences will generally occur due to a difference between the leaf boxes minimal cover and the nominal trajectory minimal cover, particularly if perturbations to the nominal trajectory would result in an alternate minimal cover. The simulation times in the above Table show that the nominal trajectory OAF is more computationally efficient than the leaf boxes OAF, with simulations taking approximately 20-25% of the computation time for the leaf boxes OAF.

The number of binary variables for the different OAF algorithms is given by the following table:

| | Number of Binary Variables |
|---|---|
| Root Boxes | $2N_D N$ |
| Leaf Boxes | $2N_D N \times 2^{N_L-1}$ |
| Implicit | $N\,[2N_D(2^{N_L}-1)+(2^{N_L-1}-1)]$ |

Figure 11:
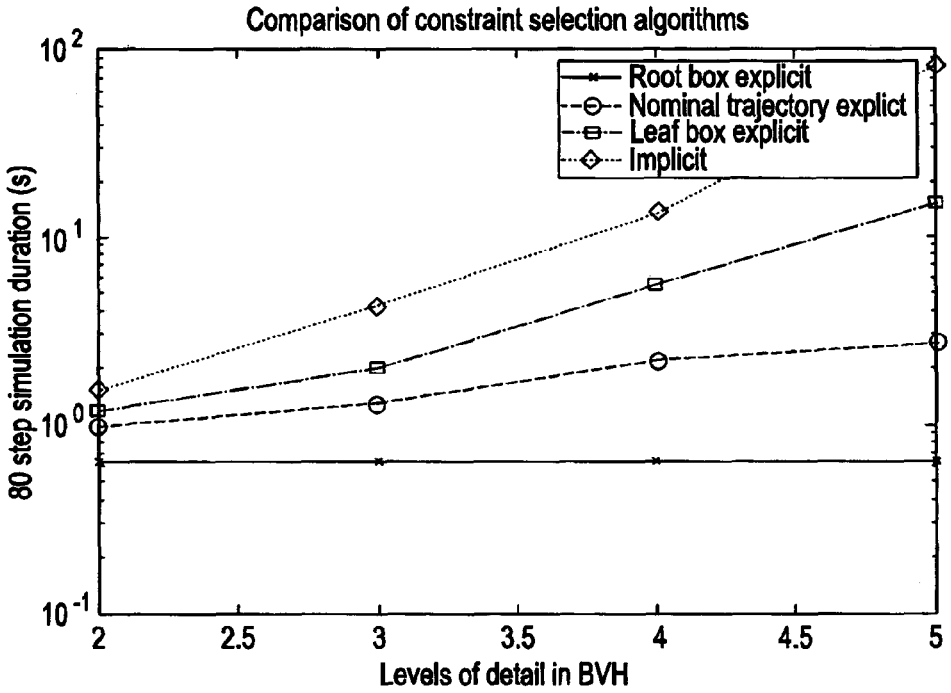
FIG. 11 illustrates a comparison of simulation times for the different OAF algorithms and BVH complexities.

FIG. 11 shows how the simulation times of the four different OAF algorithms change with respect to the complexity of the BVH, which is given by the number of levels ($N_L$) within the BVH binary tree. The simulation times of the implicit and leaf boxes OAF increase significantly due to the increase in the number of binary variables. This increase occurs because the number of binary variables required for both formulations are exponential with respect to $N_L$ (see Table 2), and the worst case computation cost of an MIP is exponential with respect to the number of binary variables. FIG. 11 also shows that the nominal trajectory OAF does increase, although not by as much as the leaf boxes OAF, and is less costly than the leaf boxes OAF. The root box algorithm is constant as $N_L$ has no affect on its runtime.

5 Reducing Computational Cost Using Reachable Sets

The computational cost of the OAF can be further reduced by removing obstacles or parts thereof that are not reachable at a given time-step in the prediction horizon from the MIP. Within the context of the OAF formulations presented in Sections 2 and 4, reachability can be used to (i) simplify the BVH for a given obstacle by removing ABBs and branches of the tree that are not reachable, and (ii) remove polytopal obstacles and constraints that are not reachable at a given prediction step from the OAF MIP. Reachability is defined in terms of the region in the state space X that can be reached in a given time period: the reachable set.

Definition: The one-step reachable set is defined as the set containing all possible successor states for a given state or set of states $\mathcal{Y}$, i.e.

$$\mathcal{R}(\mathcal{Y})=\{\chi^+\in\mathfrak{R}^n:\forall u\in\mathbb{U},\ \forall\chi\in\mathcal{Y},\ \chi^+=f(\chi,u)\}. \tag{5.1}$$

Definition The i-step reachable set is recursively defined as the repeated application of the one-step reachable set:

$$\mathcal{R}_x(\mathcal{Y})=\mathcal{R}(\mathcal{R}_{x-1}(\mathcal{Y})), \tag{5.2}$$

with $\mathcal{R}_0(\mathcal{Y})=\mathcal{Y}$.

5.1 Simplification of Bounding Volume Hierarchies Using Reachable Sets

The number of ABBs within a BVH that are considered in a computation can be reduced using reachability. This reduction is performed by (i) culling boxes and branches of the BVH that are not reachable, and (ii) replacing a box with one of its children within the BVH, when only that child is reachable. This BVH simplification strategy relies on the following propositions:

Proposition 5.1 If an ABB within the BVH is not reachable (i.e. it does not intersect with the reachable set), then none of its descendants are reachable.

Proof Let $\overline{B}$ be a descendant box of B, $B\cap\mathcal{R}=\emptyset$, and $\mathcal{G}(B)$ is defined as the geometry that is bounded by B ($\mathcal{G}(b)\subset B$). Since B is a descendant of B, then $\mathcal{G}(B)\subseteq\mathcal{G}(B)$. By the transitive property of $\subset$, $\mathcal{G}(B)\cap\mathcal{R}=\emptyset$, hence if B is culled due to being non-reachable, its descendants should also be culled.

Proposition 5.2 If reachable set R intersects a box $B_{lm}$, and only one of the box's children $B_{l+1,q1}$, then box $B_{l;m}$ can be replaced by its child $B_{l+1;q}$ within the BVH.

Proof Let $B_{l+1,q1}$ and $B_{l+1;q2}$ be the two child boxes of $B_{l;m}$. Also $B_{l;m}$ and $B_{l+1;q1}$ intersect with reach set, R, while $B_{l+1;q2}$ does not. $\mathcal{R}\cap\mathcal{G}(B_{lm})=\mathcal{G}\cap\mathcal{R}(B_{l+1,q1})$ since $\mathcal{G}(B_{l,m})=\mathcal{G}(B_{l+1,q1})\cup\mathcal{G}(B_{l+1,q2})$ and $\mathcal{R}\cap\mathcal{G}(B_{l+1,q2})=\emptyset$. Hence, $\mathcal{R}\cap\mathcal{G}(B_{lm})\subseteq B_{l+1,q1}$.

Propositions 5.1 and 5.2 can be used together to synthesize an algorithm that simplifies a BVH for a given reachable set $\mathcal{R}$ by traversing the tree. This recursive algorithm first determines whether the children of a candidate box are reachable, and removes all the non-reachable children and their descendants from the BVH. If only one child remains, it replaces the candidate box in the BVH, and has the recursive algorithm run on it. If more than one child is reachable, the candidate box remains in the tree and recursion proceeds to its reachable children. FIG. 12 shows how this recursive algorithm can be used to simplify a BVH, where the colored-in dots represent the boxes that intersect with reachable set $\mathcal{R}$. FIG. 12(*a*) shows the entire BVH, and FIG. 12(*b*) shows the simplified BVH. The simplification of the BVH will result in either a reduction in the number of binary variables required to represent an obstacle or an increase in the detail of the representation.

5.2 Reduction of Polytopal Obstacle Constraints Using Reachability

The number of binary variables required to represent $\mathcal{O}$ at a given prediction time-step can be reduced by culling the obstacles and constraints that cannot be reached from the OAF MIP. This idea is analogous to that set out previously by Kuwata (2003) and Richards et al. (2003), both of whom use approximations of the reachable set of the entire prediction horizon to cull constraints representing obstacles outside this set from the OAF MIP. Culligan (2006) further reduced the number of binary variables in the MIP by including, for each time step in the planning horizon, only the obstacles that could be reached at that time step.

A further new reduction is achieved by including only the constraints that are necessary to represent the part of the obstacle set that intersects with the reach set. Specifically, it reduces the number of constraints (hence, binary variables) required to represent a convex polytopal obstacle, $O_j$, that is not completely inside the reach set, $\mathcal{R}_k$ Only constraints that are active for some state within $\mathcal{R}_k/O_j$ are selected. The constraint, $\{\chi:a_{ij}\chi\le b_{ij}\}$, is selected if.

$$\mathcal{R}_k\cap\{\chi:a_{i,j}\chi\le b_{i,j}\}\neq\emptyset. \tag{5.3}$$

The reachable constraints are then represented by the index set, $$I_{j,k}=\{i\in\{1,2,\ldots,N_h(O_j)\}:\mathcal{R}_k\cap\{\chi:-a_{i,j}\chi\leq-b_{i,j}\}\neq\emptyset\},\tag{5.4}$$

and the induced obstacle is given by $$\mathcal{O}_{j,k}=\bigcap_{i\in\mathcal{I}_{j,k}}\{x\in\mathcal{R}_k:-a_{i,j}x\leq-b_{i,j}\}.\tag{5.5}$$

The induced obstacle is a subset of the reach set, $\mathcal{R}_k$, and can also be expressed as the intersection of the $O_j$ with $\mathcal{R}_k$.

Three possible situations occur if an obstacle $O_j$ intersects with reach set $\mathcal{R}_k$:

1. $O_j\subseteq\mathcal{R}_k$ (see FIG. 13(*a*)): Here, all of the half-spaces will be required to represent the obstacle. The formulation of Eqns. 3.6 and 3.7 are used to determine the constraints for $O_j$. The induced obstacle for time k is given by $O_{jk}=O_j$.
2. $O_j\not\subseteq\mathcal{R}_k$ with two or more constraints reachable, i.e. $|I_{jk}|\geq2$ (see FIG. 13(*b*)).

The mixed integer linear inequalities for $O_j$ at time k are:

$$-a_{i,j}^Tx\leq-b_{i,j}+M\alpha_{i,j,k},\ \forall\ i\in\mathcal{I}_{j,k},\tag{5.6}$$

$$\sum_{x\in\mathcal{I}_{j,k}}\alpha_{i,j,k}\leq|\mathcal{I}_{j,k}|-1,\tag{5.7}$$

where |.| indicates the number of elements in the index set.

3. $O_j\not\subseteq\mathcal{R}_k$ with only a single constraint reachable, i.e. $|I_{jk}|=1$ (see FIG. 13(*c*)). No binary variables are required as only a single linear inequality is required to represent $O_j$ in $\mathcal{R}_k$. The constraint is $$-a_{i,j}^T\chi\leq-b_{i,j},\ \text{for}\ i\in\mathcal{I}_{j,k}.\tag{5.8}$$

The number of binary variables that can be removed from the OAF MIP using the reachable constraint method, will depend on the dynamics of the slave, the closeness of the reachable set approximation to the true reachable set, and the geometry of the obstacles. Note that when $O\subseteq\mathcal{R}_k\forall k=1,\ldots,N$, there will be no reduction in the number of binary variables; in this situation other OAF algorithms, such as those presented in Sections 2 and 4, can be used.

5.3 Reachable Constraint Method for Axially-Aligned Bounding Boxes

Reachable constraints can be efficiently determined for the case where the obstacle $O_j$ and the reachable set (or its approximation) $\mathcal{R}_k$ are ABBs, by modifying the standard algorithm for testing whether a pair of ABBs intersect (Cohen et al. 1995). This algorithm determines whether two ABBs intersect involves by projecting the boxes onto each axis, and determining whether the projections overlap. If the projections overlap on all axes, then the ABBs overlap. The modified algorithm stores whether the bounds of the obstacle overlap as boolean variables, $I_{i,j,k}$, and, if the obstacle intersects with the reach set, these variables are used to determine the reachable constraint index set $I_{j,k}$ directly.

Since the only modifications to the standard algorithm are (i) the storage of the $I_{i,j,k}$ variables, and (ii) the construction of set $I_{j,k}$, the modified algorithm requires only a minor increase in computational resources over the standard ABB intersection test algorithm. The operation of the modified intersection algorithm in 2D is presented in Algorithm 3: Pairwise ABB-intersection algorithm - reachable constraint method

```
Data: ABB reach box or ABB approximation to reach set:
      R_k = [x_min,R_k, x_max,R_k] × [y_min,R_k, y_max,R_k]
Data: ABB obstacle O_j = [x_min,j, x_max,j] × [y_min,j, y_max,j]
Result: Active constraint index set, I_j,k
begin
  | I_j,k = ∅
  | Test projections onto axes for overlap (True/False):
  | r_x,min = x_min,R_k ∈ [x_min,j, x_max,j] , r_x,max = x_max,R_k ∈ [x_min,j, x_max,j]
  | I_1,j,k = x_min,j ∈ [x_min,R_k , x_max,R_k] , I_2,j,k = x_max,j ∈ [x_min,R_k , x_max,R_k]
  | r_y,min = y_min,R_k ∈ [y_min,j, y_max,j] , r_y,max = y_max,R_k ∈ [y_min,j, y_max,j]
  | I_3,j,k = y_min,j ∈ [y_min,R_k , y_max,R_k] , I_4,j,k = y_max,j ∈ [y_min,R_k , y_max,R_k]
  | Test for intersection (Do the boxes overlap on both axes?):
  | if (r_x,min ∨ r_x,max ∨ I_1,j,k ∨ I_2,j,k) ∧ (r_y,min ∨ r_y,max ∨ I_3,j,k ∨ I_4,j,k) then
  |   | ABB's collide
  |   | for i = 1 to ∮ do
  |   |   | if I_i,j,k = true then
  |   |   |   | append i to I_j,k
end
```

Algorithm 3.

This algorithm can be extended to higher dimensions with only minimal modifications (projecting to the new axis/axes and requiring the additional projections to overlap also for intersection of the ABB).

5.4 Recursive Feasibility for Reachable Constraints

We now show that the reachable constraint method is recursively feasible when applied to (i) a constant obstacle set $\mathcal{O}$, and (ii) an obstacle set that can change at each time step according to Corollary 4.3, $\mathcal{O}^k$:

Proposition 5.3 Recursive feasibility holds for (i) a constant obstacle set, and (ii) an obstacle set that can change at each time step according to Corollary 4.3, with constraints determined using the reachable constraint method.

Proof Part (ii) is considered first. It is assumed there is a feasible trajectory at time k, $$T_k=\{\chi_k,\chi_{k+1},\ldots,\chi_{k+N}\}\cup X_T,\tag{5.9}$$

satisfying the following constraints $$\chi_{k+p+1}=f(\chi_{k+p},u_{k+p}),\ \forall p=0,\ldots,(N-1),\tag{5.10}$$

$$(\chi_{k+p},u_{k+p})\in\mathcal{P},\ \forall p=0,\ldots,(N-1)\tag{5.11}$$

$$\chi_{k+p}\notin\mathcal{O}^{k,p}(\chi_k),\ \forall k=1,\ldots,(N-1),\tag{5.12}$$

$$\chi_{k+N}\in X_T,\tag{5.13}$$

$$X_T\cap\mathcal{O}^{k,p}=\emptyset,\tag{5.14}$$

where $\mathcal{O}^{k,p}(\chi_k)=\mathcal{O}^k\cap\mathcal{R}_p(\chi_k)$. Assuming that $T_k$ can be exactly implemented in the future, it is possible to construct a trajectory at the next time step, $$T_{k+1}=\{\chi_{k+1},\chi_{k+2},\ldots,\chi_{k+N},f(\chi_{k+N},K(\chi_{k+N}))\}\cup X_T,\tag{5.15}$$

which is a subset of the trajectory at the previous time step ($T_k$). In order for recursive feasibility to be established, it is necessary to show that $T_{k+1}$ is feasible if $T_k$ is feasible. The dynamic and system constraints (Eqn. 5.10 and 5.11) for $T_{k+1}$ are satisfied as it is a subset of the $T_k$. The constraints in Eqns. 5.13 and 5.14 are satisfied for the $T_{k+1}$ due to the invariance of $X_T$.

It remains necessary to show that this trajectory will satisfy the obstacle avoidance constraints induced by the reachable sets from $\chi_{k+1}$, that is:

$$\chi_{k+p}\notin\mathcal{O}^{k+1,p-1}(\chi_{k+1}),\ \forall p=2,\ldots,N\tag{5.16}$$

Since $\mathcal{R}_{p-1}(\chi_{k+1})\subseteq\mathcal{R}_p(\chi_k)$ (as $\mathcal{R}_{p-1}(\chi_{k+1})$ is a restriction of $\mathcal{R}_p(\chi_k)$, with the additional constraint that the state at time k+1 is $\chi_{k+1}$) and $\mathcal{O}^{k+1}\subseteq\mathcal{O}(T_k)$, where $\mathcal{O}(T_k)$ is the a posteriori obstacle set for time k (by the condition of Corollary 4.3). The induced obstacle sets are related by:

$$\mathcal{O}^{k+1,p-1}(\chi_{k+1}) \subseteq \mathcal{R}_p(\chi_k) \cap \mathcal{O}(T_k). \tag{5.17}$$

It follows from Eqn. 5.17, and the fact that $\mathcal{O}^k \subseteq \mathcal{O}(T_k)$:

$$\chi_{k+p} \notin \mathcal{O}^{k,p}(\chi_k) \rightarrow \chi_{k+p} \notin \mathcal{O}^{k+1,p-1}(\chi_{k+1}), \forall p.$$

Hence, all constraints are satisfied for $T_{k+1}$, if the constraints, Eqn 5.10 to 5.14, are satisfied for $T_k$. The recursive feasibility condition given in Eqn. 5.17 also holds trivially when the obstacle set is constant, since $T_k$ is feasible with respect to $\mathcal{O}$, so (i) is also satisfied.

5.5 Evaluation of OAF Algorithms Using the Reachable Constraint Method

The leaf boxes and nominal trajectory OAF algorithms, using the reachable constraint method, are evaluated against the corresponding unmodified OAF algorithm. The OAF algorithms uses the reachable constraint method should produce the same trajectory, more computationally efficiently than the corresponding unmodified OAF method. The dynamic model and OAF formulation presented in Section 4.4 are used, again, for these simulations.

The reachable constraint method utilizing ABBs, requires an ABB approximations to the reachable sets can be calculated. These ABBs are calculated using a method similar to the one presented in Culligan (2006). The approximate reachable sets, $$\mathcal{R}_p(\chi_k) = [\chi_{k+p,min}, \chi_{k+p,max}] \times [\mathcal{Y}_{k+p,min}, \mathcal{Y}_{k+p,max}], \quad \forall p = 1, \ldots, N \tag{5.18}$$

are calculated by solving the following models:

$$\chi_{k+p,min} = f(\chi_{k+p-1,min}, u_{min}), \forall p = 1, \ldots, N, \tag{5.19}$$

$$\chi_{k+p,max} = f(\chi_{k+p-1,max}, u_{max}), \forall p = 1, \ldots, N, \tag{5.20}$$

$$\chi_{k,max} = \chi_{k,min} = \chi_k. \tag{5.21}$$

where the maximal and minimal inputs are given by:

$$u_{min} = \underset{u}{\operatorname{argmin}}\{1^T u : u \in \mathbb{U}\}, \tag{5.22}$$

$$u_{max} = \underset{u}{\operatorname{argmax}}\{1^T u : u \in \mathbb{U}\}. \tag{5.23}$$

This formulation will produce outer approximation to reach sets for linear systems with system matrices having all positive or zero elements, such as the model presented in Section 4.4.

Figure 14:
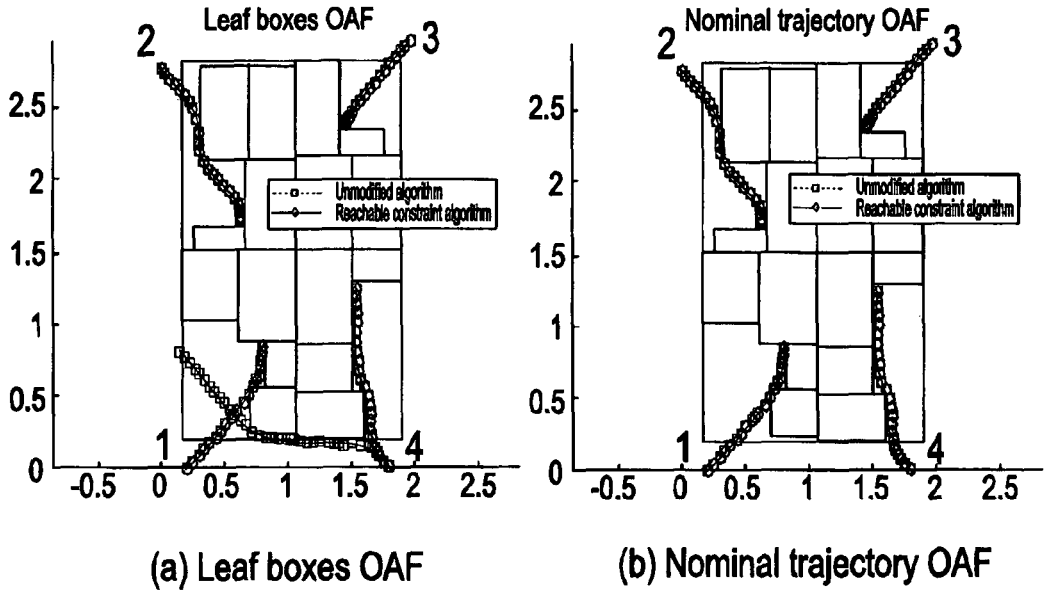
FIG. 14 illustrates comparison between trajectories generated by unmodified OAF algorithms, and those that use the reachable constraint method to determine constraints. With the exception of situation 4 in (a), which is due to the order of branching in the MIQP solver (as in FIG. 10), all of the trajectories correspond.

FIG. 14 and the table below show the comparisons between OAF algorithms using the reachable constraint method and unmodified OAF algorithms FIG. 14 shows that the trajectories for each starting point correspond for both the leaf node OAF and the nominal trajectory OAF, except for Trajectory 4 of the Leaf boxes OAF. This behaviour is due to the ordering of the branching in the MIQP when the minimal-cost trajectory is not unique. Table 3 shows that OAF algorithm using the reachable constraint method to have significantly shorter run times than the corresponding unmodified OAF algorithm. Hence, the reachable constraint method should be used where reachable sets and the resulting reachable constraints can be determined efficiently, e.g. when the reach set and obstacles are represented using ABBs.

The table below shows a simulation time comparison between unmodified OAF algorithms and OAF algorithms using the reachable constraint method. These simulations were run on an Intel Core 2 Duo E6300 (single core only) with 4 GB of RAM, where the OAF MIQP is solved using CPLEX10.2 (ILOG 2007). Times in seconds.

| | | 1 | 2 | 3 | 4 |
|---|---|---|---|---|---|
| Leaf Boxes | Unmodified | 15.09 | 15.13 | 14.44 | 12.66 |
| | Reachable constraints only | 3.33 | 2.75 | 2.51 | 3.42 |
| Nominal | Unmodified | 3.67 | 2.86 | 3.16 | 3.37 |
| Trajectory | Reachable constraints only | 1.49 | 1.31 | 1.38 | 1.65 |

6. Simulation Example Based on Simplified Mining Shovel-Truck Avoidance Problem

Figure 15:
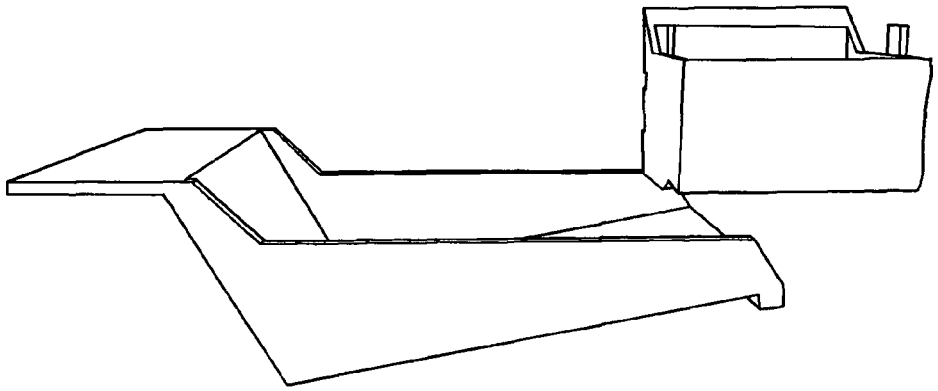
FIG. 15 illustrates a Truck tray (left) and dipper (right).

The example considered in this section is that of a simplified cartesian excavator, where an operator loads material into a truck tray (FIG. 15, left) by commanding the velocity of the dipper (FIG. 15, right).

The scenario that is simulated in this section is of an operator making his first loading pass of an empty truck tray with the dipper, but failing to lift out or stop the dipper inside the truck tray. This is modeled as a constant operator command input over the simulation. The nominal trajectory OAF algorithm, using the reachable constraint method, and a lookahead of 1 second (or 5 samples) will be used to avoid collisions. The dynamics and kinematics in this example have been simplified: the motion is pure translation, and each degree of freedom (DOF) has double integrator dynamics with proportional rate feedback. Each DOF is aligned to a cartesian axis. The x DOF has twice the effective inertia, and can travel at twice the velocity of the y DOF and z DOF.

The discrete time model for the system ($\Delta t = 0{:}2s$) is $$\begin{bmatrix} x_{k+1} \\ u_{x,k+1} \\ y_{k+1} \\ u_{y,k+1} \\ z_{k+1} \\ u_{z,k+1} \end{bmatrix} = \begin{bmatrix} 1 & 0 & 0 & 0.1264 & 0 & 0 \\ 0 & 1 & 0 & 0 & 0.08647 & 0 \\ 0 & 0 & 1 & 0 & 0 & 0.08647 \\ 0 & 0 & 0 & 0.3679 & 0 & 0 \\ 0 & 0 & 0 & 0 & 0.1353 & 0 \\ 0 & 0 & 0 & 0 & 0 & 0.1353 \end{bmatrix} \tag{6.1}$$

$$\begin{bmatrix} x_k \\ v_{x,k} \\ y_k \\ v_{y,k} \\ z_k \\ v_{z,k} \end{bmatrix} + \begin{bmatrix} 0.07358 & 0 & 0 \\ 0 & 0.1135 & 0 \\ 0 & 0 & 0.1135 \\ 0.6321 & 0 & 0 \\ 0 & 0.8647 & 0 \\ 0 & 0 & 0.8647 \end{bmatrix} \begin{bmatrix} u_{x,k} \\ u_{y,k} \\ u_{z,k} \end{bmatrix}.$$

The corresponding velocity, command and actuator constraints for this system are $$v_x \in [-2,2],\ v_y,\ v_z \in [-1,1], \tag{6.2}$$

$$u_x \in [-2,2],\ u_y,\ u_z \in [-1,1], \tag{6.3}$$

$$10(u_q - v_q) \in [-1,1],\ q = x,y,z. \tag{6.4}$$

Again, the zero-velocity, collision-free invariant set is utilized as the OAF terminal invariant set:

$$X_T = \{\chi \in \mathbb{X} / \mathcal{O} : v_x = 0,\ v_y = 0,\ v_z = 0\}, \tag{6.5}$$

and the associated terminal feedback control is $$u_{x,T} = 0,\ u_{y,T} = 0,\ u_{z,T} = 0. \tag{6.6}$$

The invariant set and associated control law is included in the OAF MIQP using the following constraints:

$$\chi_{k+N} \notin \mathcal{O}, \tag{6.7}$$

$$v_{x,k+N}=0,\ v_{y,k+N}=0,\ v_{z,k+N}=0, \tag{6.8}$$

$$u_{x,k+N}=0,\ u_{y,k+N}=0,\ u_{z,k+N}=0. \tag{6.9}$$

Object-object avoidance constraints can be represented using the Minkowski Sum, as the motion of the dipper is pure translation. The Minkowski Sum is defined as the exhaustive sum of two sets, A and B:

$$\mathcal{A} \oplus \mathcal{B} = \{a+b : \forall a \in \mathcal{A},\ \forall b \in \mathcal{B}\}$$

The set representing the geometry of the dipper for a given state $\chi$ (since the dipper's motion is pure translation) is:

$$X_D(\chi) = C_p\chi \oplus X_D \tag{6.10}$$

where Cp: $\mathbb{X} \rightarrow \Re^3$ is the projection matrix from the state to the position space (Note that in general, the relationship between the state and position spaces may not be linear, particularly if rotation states are involved), and $\chi_D \subset \Re^3$ is the set representing the geometry of the dipper when the state is at the origin. Hence, the object-object obstacle avoidance constraint for the cartesian excavator is given by:

$$(C_p\chi \oplus X_D) \cap \mathcal{O}_T = \emptyset \tag{6.11}$$

where $\mathcal{O}_T \subset \Re^3$ represents the geometry of the truck tray. Equation 6.11 can be transformed into a point-object constraint using the Minkowski sum:

$$C_p\chi \notin [\mathcal{O} \oplus (-X_D)] \tag{6.12}$$

where $-\chi = \{-\chi, \forall \chi \in X\}$.

Figure 16:
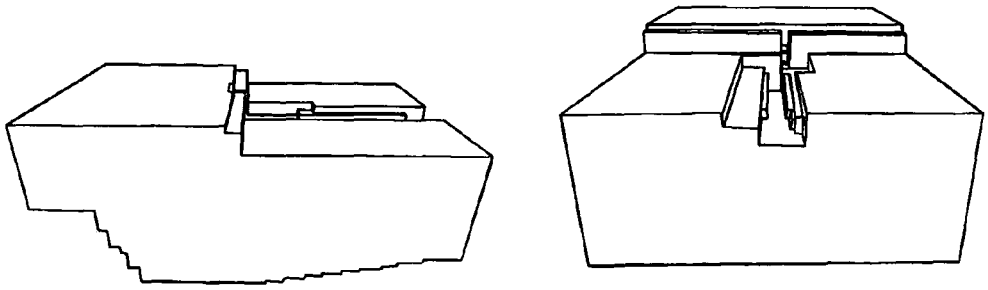
FIG. 16 illustrates a Leaf boxes approximation to the truck tray-dipper obstacle set (256 boxes).

The level-of-detail point-polytope avoidance constraints are calculated using a method based on the method to determine Minkowski bounding trees, presented in Smith (2008): A BVH of ABBs for the tray is constructed, and the BVH of the obstacle set is found by taking Minkowski sum of the truck tray BVH box-wise with an ABB of the dipper (effectively the root box of the BVH of the dipper). FIG. 16 shows the leaf boxes of the Minkowski Bounding Tree of the dipper-truck tray obstacle set.

Figure 17:
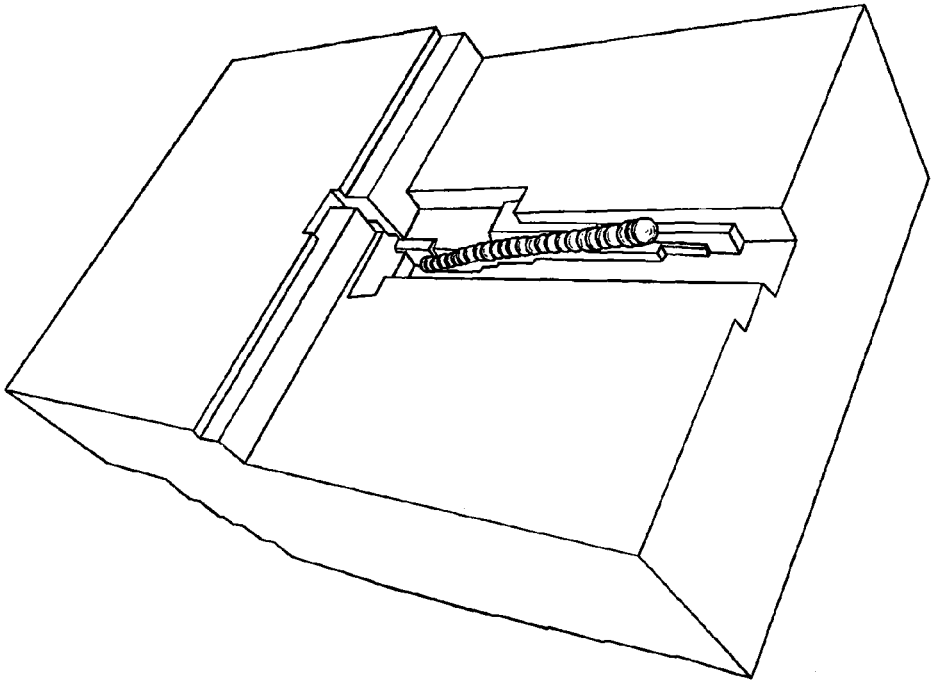
FIG. 17 illustrates a simulation of loading pass using an OAF in the state space.
Figure 18:
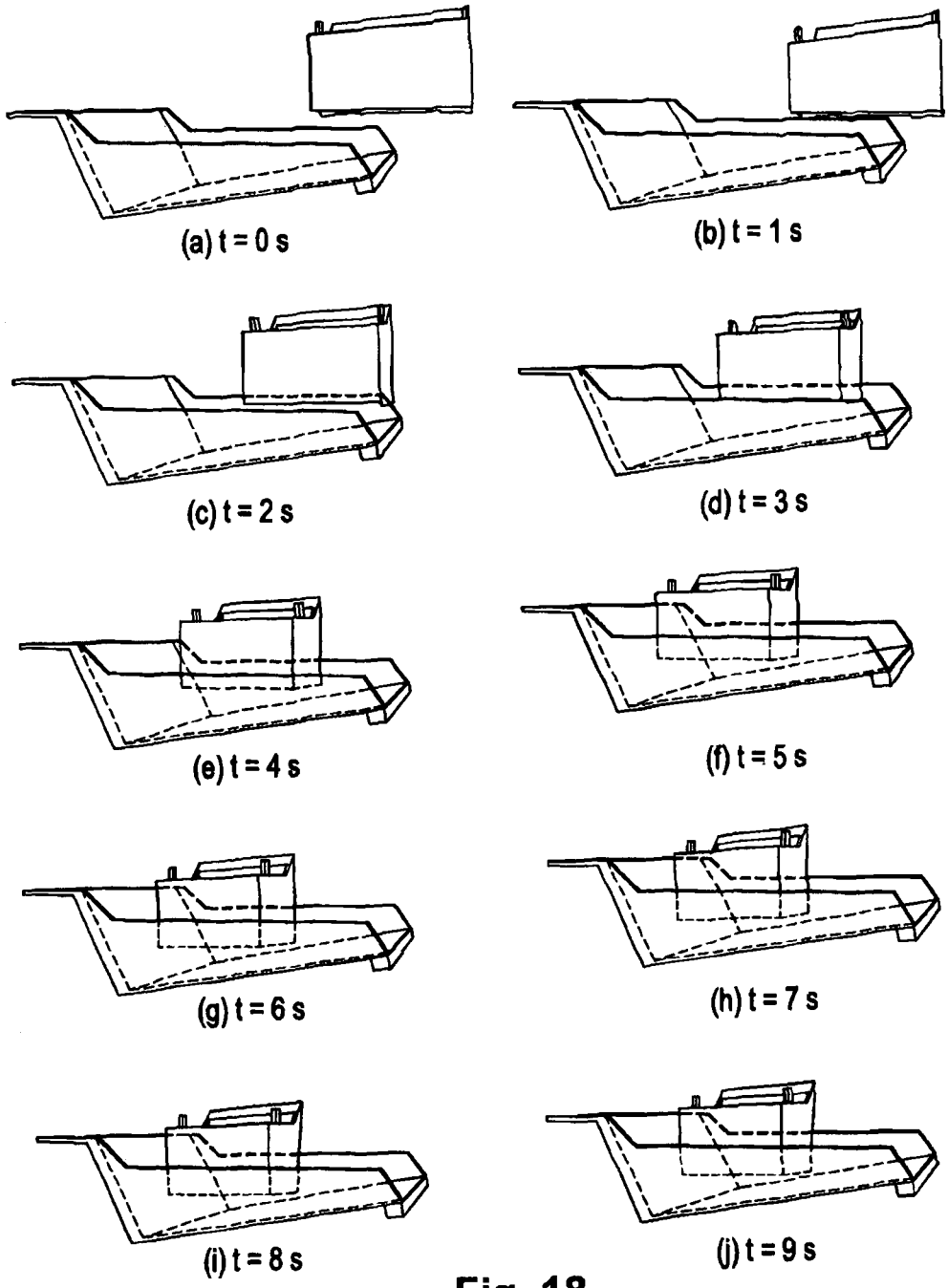
FIG. 18 illustrates a simulation of loading pass using an OAF.

FIG. 17 shows the leaf boxes of the BVH representing the state space obstacle and the resulting trajectory (white spheres), while FIG. 18, shows corresponding snapshots of the relative motion of the dipper to the truck tray. Both figures show that the dipper successfully avoids colliding with the shovel.

7 Conclusions

The preferred embodiment provides for an effective OAF, which is interposed between a human operator and the slave manipulator, to assist the operator in avoiding collisions by minimally altering the operator's command. The OAF formulation addresses the challenges inherent in assisting human operators in avoiding obstacles, namely it deals with the non-causal structure of the problem, and accounts for that the dynamics and performance limitations of the system when determining the alteration to the operator's command. The main contribution of the paper though is in incorporating geometric level of detail into the OAF framework to produce a computationally efficient algorithm for avoiding non-convex obstacles. The present results, while simulation-based only, are sufficiently promising to suggest that the OAF can work in practice for a suitable application.

Interpretation

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the above description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

Furthermore, some of the embodiments are described herein as a method or combination of elements of a method that can be implemented by a processor of a computer system or by other means of carrying out the function. Thus, a processor with the necessary instructions for carrying out such a method or element of a method forms a means for carrying out the method or element of a method. Furthermore, an element described herein of an apparatus embodiment is an example of a means for carrying out the function performed by the element for the purpose of carrying out the invention.

In the description provided herein, numerous specific details are set forth. However, it is understood that embodiments of the invention may be practiced without these specific details. In other instances, well-known methods, structures and techniques have not been shown in detail in order not to obscure an understanding of this description.

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner In the claims below and the description herein, any one of the terms comprising, comprised of or which comprises is an open term that means including at least the elements/features that follow, but not excluding others. Thus, the term comprising, when used in the claims, should not be interpreted as being limitative to the means or elements or steps listed thereafter. For example, the scope of the expression a device comprising A and B should not be limited to devices consisting only of elements A and B. Any one of the terms including or which includes or that includes as used herein is also an open term that also means including at least the elements/features that follow the term, but not excluding others. Thus, including is synonymous with and means comprising.

Similarly, it is to be noticed that the term coupled, when used in the claims, should not be interpreted as being limitative to direct connections only. The terms "coupled" and "connected," along with their derivatives, may be used. It should be understood that these terms are not intended as synonyms for each other. Thus, the scope of the expression a device A coupled to a device B should not be limited to devices or systems wherein an output of device A is directly connected to an input of device B. It means that there exists a path between an output of A and an input of B which may be a path including other devices or means. "Coupled" may mean that two or more elements are either in direct physical or electrical contact, or that two or more elements are not in direct contact with each other but yet still co-operate or interact with each other.

Although the present invention has been described with particular reference to certain preferred embodiments thereof, variations and modifications of the present invention can be effected within the spirit and scope of the following claims.

We claim:

1. A method of implementing an optimal avoidance filter for interposing between movement commands issued by a human operator and a machine control system of a movable machine operated by the human operator, for the avoidance of collisions with objects, the method comprising:

(a) inputting a detailed representation of the objects in a vicinity of the movable machine;

(b) formulating a hierarchical set of bounding boxes around the objects, the hierarchical set including refinement details depending on a current positional state of the movable machine, with the objects closer to the movable machine having higher levels of refinement details; and (c) utilizing, by the processor, the hierarchical set as a set of constraints for an optimization program to determine any alterations to the issued movement commands so as to avoid collisions with the objects.

2. The method as claimed in claim 1 wherein the set of constraints comprise mixed integer constraints and the optimization program comprises a mixed integer optimization program.

3. The method as claimed in claim 1 further comprising:

(d) utilizing a the predicted future motion to update the hierarchical set.

4. The method as claimed in claim 1 wherein step (c) further comprises the step of:

determining a series of alternative alterations to the issued movement commands, and costing the series in terms of a magnitude of alteration, and utilizing a lower cost alternative alteration.

5. The method as claimed in claim 1 wherein steps (a) to (c) are applied in a continuous iterative manner.

6. The method as claimed in claim 1 wherein the hierarchical set of bounding boxes are axially aligned.

7. The method as claimed in claim 1 wherein the hierarchical set of bounding boxes includes representation of non convex objects, in a form of convexities in the hierarchical set.

8. The method as claimed in claim 1 wherein step (b) further comprises, for any particular time interval, culling members of the hierarchical set that are not reachable in a current time interval.

* * * * *